United States Patent [19]

Liebowitz

[11] Patent Number: 4,724,883

[45] Date of Patent: Feb. 16, 1988

[54] DRAPERY AND VERTICAL BLIND SYSTEM

[76] Inventor: Martin N. Liebowitz, 1155 Hillsboro Mile (A1A)-Ste. 602, Hillsboro Beach, Fla. 33062

[21] Appl. No.: 815,380

[22] Filed: Dec. 31, 1985

Related U.S. Application Data

[63] Continuation-in-part of Ser. No. 797,172, Nov. 7, 1985, abandoned, which is a continuation of Ser. No. 478,166, Mar. 23, 1983, abandoned.

[51] Int. Cl.[4] ..... A47H 1/08

[52] U.S. Cl. ..... 160/84 R; 160/196 D; 160/345

[58] Field of Search ..... 160/330, 345, 124–126, 160/196, 198; 16/93–96

[56] References Cited

U.S. PATENT DOCUMENTS

| | | | |
|---|---|---|---|
| 297,627 | 4/1884 | Page et al. | 160/345 |
| 2,625,219 | 12/1953 | Peck | 160/166 A |
| 2,736,373 | 2/1956 | Truesdale | 160/345 |
| 3,023,450 | 3/1962 | Renner et al. | 16/95 D |
| 3,234,997 | 2/1966 | Ford | 160/345 |
| 3,247,893 | 4/1966 | Ford | 160/345 |
| 3,251,400 | 5/1966 | Krule | 160/196 |
| 3,314,100 | 4/1967 | Znamirowski | 16/87.4 |
| 3,434,524 | 3/1969 | Fein | 160/345 |
| 3,693,696 | 9/1972 | Salzmann | 160/345 |
| 3,743,002 | 7/1973 | Ford | 160/126 |
| 3,936,906 | 2/1976 | Takazawa | 16/87.4 R |
| 4,120,474 | 10/1978 | Hurley | 16/960 |
| 4,212,341 | 7/1980 | Fisher | 160/84 R |
| 4,240,489 | 12/1980 | Madsden | 160/345 |
| 4,291,738 | 9/1981 | Grenga et al. | 160/166 A |
| 4,449,564 | 5/1984 | Hansen et al. | 160/166 A |

FOREIGN PATENT DOCUMENTS

| | | | |
|---|---|---|---|
| 359835 | 4/1929 | Belgium . | |
| 0120425 | 10/1984 | European Pat. Off. | 248/251 |
| 1047998 | 2/1957 | Fed. Rep. of Germany . | |
| 1260720 | 6/1964 | Fed. Rep. of Germany | 160/348 |
| 2513629 | 10/1976 | Fed. Rep. of Germany . | |
| 1549736 | 12/1967 | France . | |
| 2168949 | 1/1972 | France . | |
| 2290872 | 10/1975 | France . | |

*Primary Examiner*—Robert W. Gibson, Jr.
*Attorney, Agent, or Firm*—Richard M. Saccocio

[57] ABSTRACT

A drapery support system includes an adjustable length traverse rod assembly and a plurality of movable members each adapted to include a hanger portion for connection to a pleat or fold of a drapery panel. Each of the movable members is interconnected with an adjacent movable member by an elongated elastically stretchable traverse member so that, as the panels are extended or stacked back, the pleats or folds are maintained evenly spaced by the uniform deflection of the elastic traverse member. The movable members are rotationally attached to the elastic traverse member and provided with leading edge surfaces which function to gather the elastic traverse member in predetermined arrangements and out of the way of the movable members so as to allow close stacking of the pleats of the draperies.

18 Claims, 49 Drawing Figures

DRAPERY AND VERTICAL BLIND SYSTEM

CROSS REFERENCE TO RELATED APPLICATIONS

This application is a continuation-in-part of U.S. patent application Ser. No. 797,172, filed Nov. 7, 1985, entitled "Drapery and Vertical Blind System", now abandoned, which is a continuation of U.S. patent application Ser. No. 478,166, filed Mar. 23, 1983, entitled "Drapery and Vertical Blind System," by Martin Nick Leibowitz, now abandoned.

BACKGROUND OF THE INVENTION

1. Field of the Invention

The present invention pertains in general to a drapery support and traverse system and in particular to drapery apparatus for use with one or more pleated, zig-zag, "veed" or folded drapery panels. The present invention utilizes a unique elastically stretchable member in combination with other unique apparatus to obtain a drapery system which may be premanufactured and preassembled and yet perfectly fit an opening having a range of widths while maintaining equal spacing between the pleats, zig-zags or vees.

2. Description of the Prior Art

In the art of drapery and vertical blind support systems numerous mechanisms have been developed for traversing the draperies or blinds to allow extension and retraction to form a closure across a window, doorway or to form a partition or room divider. Conventional drapery support systems typically include an elongated track for supporting a pair of master slides which are interconnected by an endless non-elastic cord and which are adapted to traverse in opposite directions to close the draperies over a window or doorway or, in the case of a single drapery panel, a single master slide is movable across the track. The draperies are formed in a plurality of folds, pleats, or "vees" which are suspended from carrier slides by separate hooks or the like.

In the prior art there are no products which may be purchased over the counter and automatically adjust to an exact width size of the opening the customer is seeking to cover. Pleated draperies are made to stock fixed sizes or custom made to a fixed exact size. The pleating of draperies is a complicated mathematical task of dividing even spaces and forming pinch pleats to create the fullness. Hiding the seams, so not to be shown, adds to the problem. Special allowances must be made for the center overlapping of the two halves of the drapery plus figuring the special allowances for the returns (the ends of the drapery that go from the track to the wall).

In the prior art there are no draperies that comprise a complete package for the consumer. The customer must buy the traverse rod separately. No traverse rod manufacturers make draperies. Thus, draperies and traverse rods have never been sold together in a single package. Installing rods and draperies is complicated for before you get started you must know the sizes without any mistakes, know where to stick the pin hooks, how far up to mount the rod, how to lock master carriers, mount pulley and remove extra non-elastic cords. This process is tough for a do-it-yourself customer. That is why decorators and installers are needed. These services sometimes cost double or triple the price and time of delivery is delayed.

The state of the art in drapery support systems is further characterized by relatively complicated mechanisms which are expensive to manufacture, are difficult to install, and typically must be custom fitted or "cut to measure." This latter item is most important. Typically, in the prior art, for any given width size of one opening, the main objective is to obtain even pleat spacing in conjunction with a desired degree of fullness when the draperies are fully drawn across the opening. This requires custom fitting. The same sized drapery cannot be used with a smaller sized opening because one or more of the pleats will remain gathered at the stationary end of the arrangement when the draperies are fully drawn. Then too, the same sized drapery cannot be used with a larger opening because it will be too narrow to fit the opening. Furthermore, in the prior art, no arrangement exists whereby after a slight drawing of the draperies, equal but variable pleat spacing exists from the partially drawn position to the fully drawn position.

Moreover, the fabrication of the draperies themselves require the formation of sewn pinch pleats which must be precisely measured and sewn and are difficult to hang properly from the support mechanism. The complex nature and the general design of prior art drapery and vertical blind traverse and closure mechanisms has been a drawback to the commercial success and convenience of such types of furnishings. Furthermore, the complexity of conventional drapery support systems has also required extensive measurement and custom fitting of the support system and the draperies supported thereby. However, in accordance with the present invention a mechanically uncomplicated and unique drapery and vertical blind support system has been provided which overcomes many longstanding problems in the art.

SUMMARY OF THE INVENTION

The present invention provides an improved drapery and vertical blind support system which is mechanically uncomplicated, automatically adjustable for a wide range of window or doorway widths without requiring custom fitting or cutting of the support mechanism or the drapery panels themselves, while providing uniform or equal pleat spacing from a partially drawn to a fully drawn position and is particularly adaptable to providing a selected range of prepackaged drapery and support mechanisms which may be fitted to a variety of applications.

In accordance with one aspect of the present invention there is provided an improved drapery or blind support track arrangement and supporting brackets therefor which is adapted to adjust for a relatively wide range of closure widths, and allow the drapery or blind panels to hang in a substantially vertical direction with improved appearance.

In accordance with another aspect of the present invention there is provided a drapery support system having an improved support track and slide mechanism which includes mechanism for providing equal spacing of the drapery pleats or blind segments in the fully closed position and over a wide range of partially open positions. In accordance with one embodiment of the invention the drapery pleat support slides or movable support members are interconnected by an elongated elastically stretchable member such as a synthetic or natural rubber elastic member having uniform stretch characteristics and which reduces in diameter when stretched, whereby the drapery may be positioned in an open, partially closed or fully closed configuration with equal spacing of the folds or pleats of the drapery panel.

In accordance with still another aspect of the present invention there is provided apparatus which provides for latching the drapery in a closed position to maintain the elastic traverse member in a stretched or extended position with the drapery pleats evenly spaced.

The present invention further provides for several embodiments of an improved drapery slide and track arrangement which is easily fabricated, mechanically uncomplicated and adapted for use with an elastic traverse member mechanism or by utilizing the elastic member memory of a drapery panel or panels having so-called permanent pressed pleats.

The present invention still further provides for an improved hanger mechanism for supporting the individual folds or pleats of a drapery panel and which is attached to or detached from the drapery panel, and does not require special fabrication sewing techniques in order to fasten the panel to the hanger.

In accordance with yet a further aspect of the present invention there is provided an improved vertical blind closure and traverse mechanism which includes a plurality of spaced apart hanger slides interconnected by dual elastic members whereby the blind segments may be traversed from a stacked back condition to a fully extended condition while maintaining equal spacing between the blind segments. The dual non-elastic cord arrangement also provides for rotating the slides to open or close the blinds.

In accordance with yet another aspect of the present invention there is provided a drapery support system particularly adapted for use with relatively heavy drapery panels or the like wherein a simplified traverse system is provided which utilizes a continuous closed loop elastic traverse member and interlocking master slides for center closure draperies or a single locking master slide for a one-way draw drapery panel. The traverse system also utilizes an elastic traverse member or pleat spacing elastic member.

In accordance with another aspect of the present invention, there is provided apparatus for automatically folding the elastic member in a pattern which prevents binding of the elastic and yet allows for very close spacing of the pleats of a drapery when fully stacked together as when the draperies are fully open.

The drapery support system of the present invention achieves several objectives and advantages in the art of drapery and vertical blind support systems. The primary advantage comprises the ability to provide a plurality of nominally sized draperies each of which fits an opening which may vary in width by as much as 24 inches and yet the spacing between the pleats is equal when the drapery is either partially or fully drawn—regardless of the actual size of the opening. Thus, there is provided a drapery having the look and quality of custom sized draperies but with the costs and manufacturing aspects of mass produced draperies and the ease of installing such draperies. Also, consumers themselves may make the draperies as provided by the present invention. The fabrication of the drapery panels is simplified in that no heavy buckram backing or other hem material is required for the drapery panels, and drapery hooks may be eliminated as well. The traverse mechanism is greatly simplified in that, in several embodiments of the invention, endless non-elastic traverse cords, pulleys, and complicated master slides are eliminated. Calculations and estimates for determining drapery width and track length are simplified. The tract configuration is aesthetically pleasing and eliminates unsightly slides, non-elastic cords, pins and other structures which are viewable from the backside of most drapery support systems. The longitudinally centered track and slide configuration provide for straight vertical hanging of the drapery and the pleats or folds in the draperies are automatically evenly spaced.

These advantages as well as other superior aspects of the present invention will be realized by those skilled in the art upon reading the detailed description which follows in conjunction with the drawings.

BRIEF DESCRIPTION OF THE DRAWINGS

FIG. 17 is a perspective view of a third alternate embodiment of a support and traverse system for vertical blinds or the like;

DESCRIPTION OF THE PREFERRED EMBODIMENTS

Figure 1:
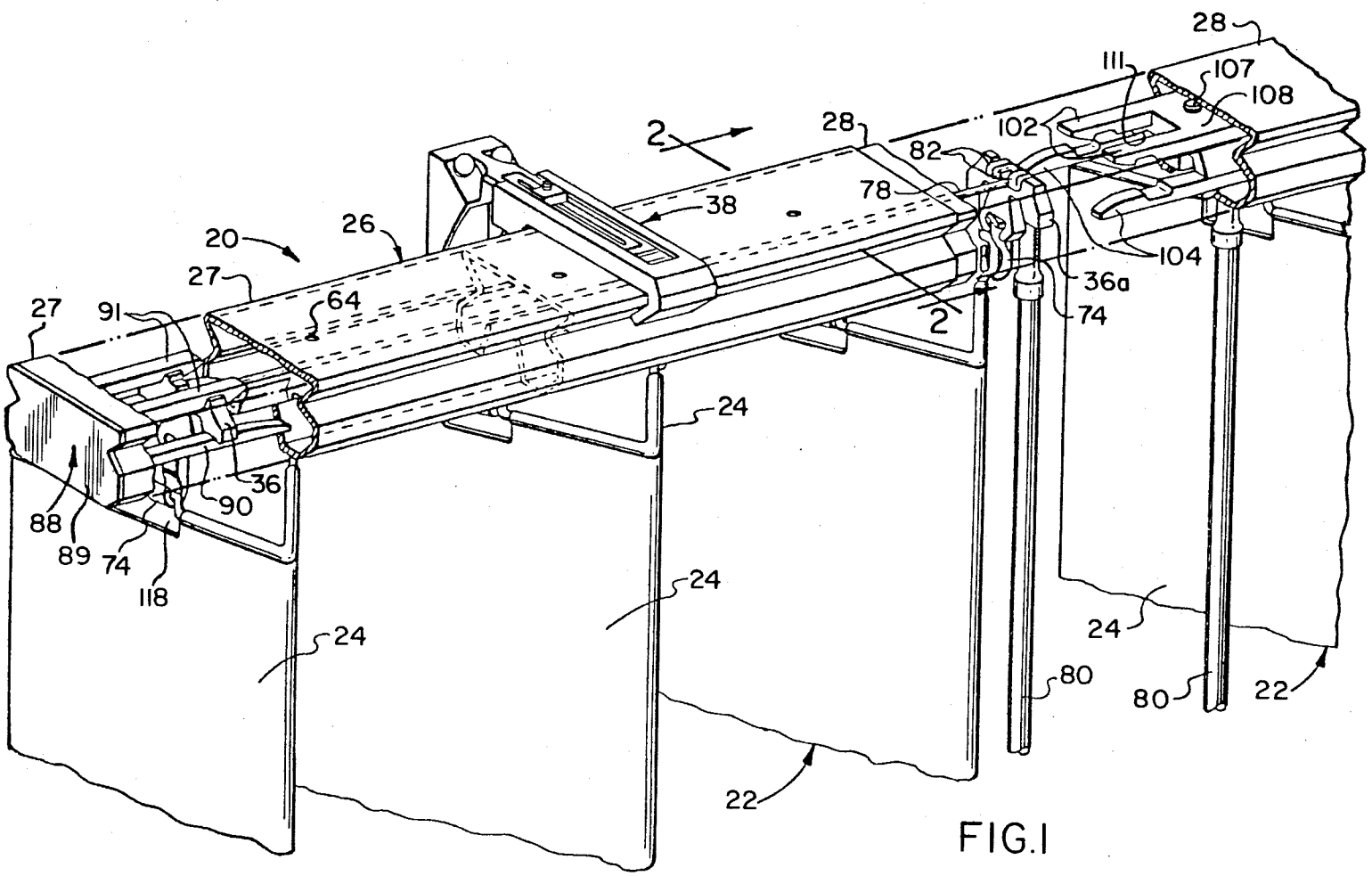
FIG. 1 is a perspective view, partially sectioned, of a drapery support system in accordance with the present invention.

In the description which follows like parts are marked throughout the specification and drawings with the same reference numerals, respectively. The drawings are not necessarily to scale and certain elements may be shown exaggerated in scale or in schematic form in the interest of clarity and conciseness.

Referring to FIG. 1, there is illustrated a drapery support system for a pleated, accordion, zig-zag or "vee" fold type drapery panel, which system is generally designated by the numeral 20. Hereinafter, the designation of the folds of this type of drapery will be referred to as "pleats" for purposes of simplicity but such designation is intended to cover all of the aforesaid types of folds. The drapery support system 20 is adapted to support various arrangements of pleated drapery panels including opposed panels which are movable toward each other to a center or offset meeting point as well as a single drapery panel which is movable across the support system between opened and closed positions. The system illustrated in FIGS. 1 and 1A comprises a center closure arrangement for a pair of pleated drapery panels 22. The drapery panels 22 are arranged in a plurality of folds or pleats 24 so that the panels may be moved from a stacked back condition with the pleats closely adjacent to each other to a partially unfolded position wherein the pleats may form an angle of approximately 90° to each other.

Figure 2:
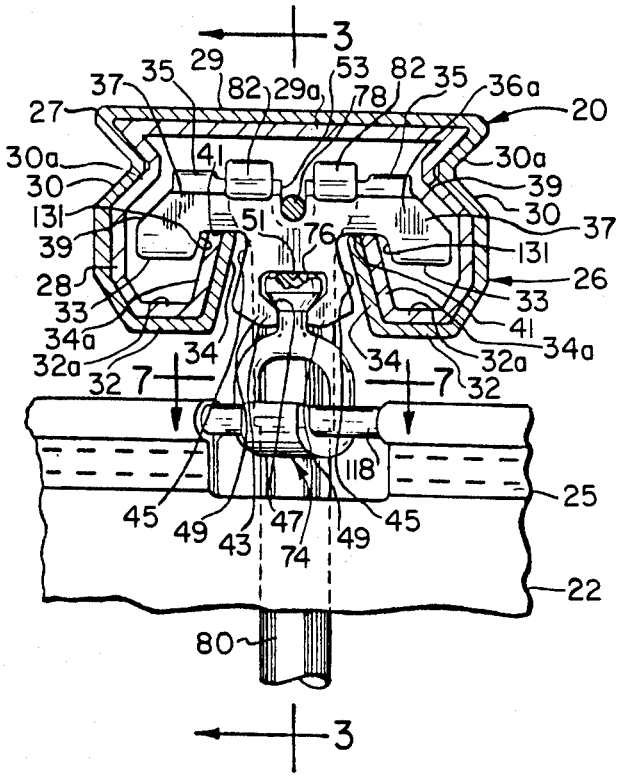
FIG. 2 is a section view taken substantially along the line 2—2 of FIG. 1.

The drapery support system 20 includes an improved mechanism for evenly spacing the pleats 24 with respect to each other and to minimize the complexity of the traverse mechanism for moving the draperies between a stacked back or open condition and a closed or fully drawn condition. The drapery support system 20 may be used with well known types of traverse rods or with an improved support track or channel, generally designated by the numeral 26. The traverse rod 26 is characterized by telescoping outer and inner sections formed by somewhat channel shaped members 27 and 28, respectively. The track sections 27 and 28 may be formed of extruded plastic or metal and are each configured, as shown in FIG. 2, to have a generally horizontal top web portion 29 and 29*a*, opposed sidewalls formed with "VEE" shaped recesses 30 and 30*a*, opposed bottom walls 32 and 32*a* and reentrant opposed flange portions 34 and 34*a*, the longitudinal top edges of which form track or bearing surfaces for a plurality of drapery panel movable support members generally designated by the term "slide" and numeral 36. An end slide of a panel is typically designated 36*a* but otherwise the slides so designated are identical. The track sections 27 and 28 are slidably disposed relative to each other in close fitting relationship and the maximum extended condition with respect to each other remain telescoped or overlapped sufficiently to form a substantially longitudinally rigid track assembly. The central opening formed between the opposed flanges 34 provides for supporting the drapery panels substantially centered with respect to the width of the traverse rod 26 which enhances the appearance of the draperies.

Figure 28:
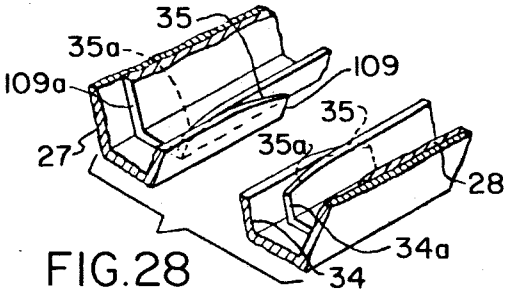
FIG. 28 is a detail view showing the ends of the flanges of the inner and outer tracks of the embodiment of FIG. 1.

Referring briefly to FIG. 28, it will be noted that the track sections 27 and 28 are formed to have the flanges 34 and 34*a* modified to slope downwardly at their respective ends, as indicated by numerals 109 and 109*a*, so that the slides 36 will not catch on the flange ends as the slides move across the ends of the respective track sections.

Figure 1A:
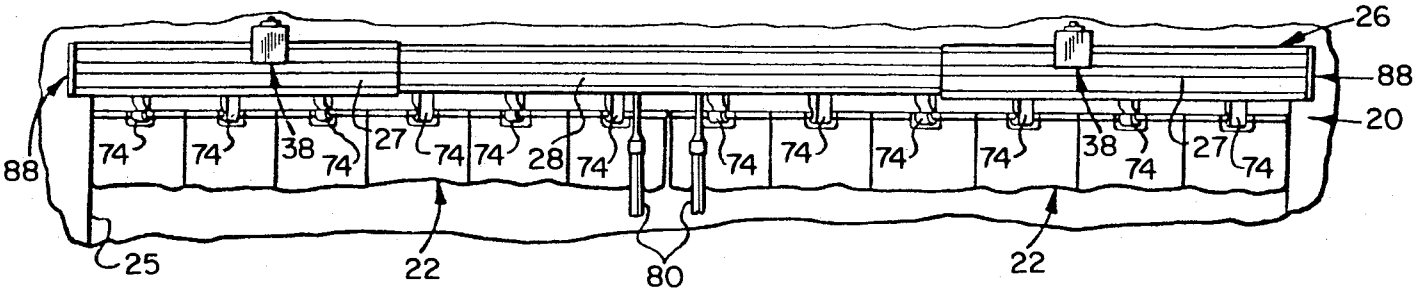
FIG. 1A is a partial vertical elevation showing the system of FIG. 1 disposed across an opening.
Figure 1B:
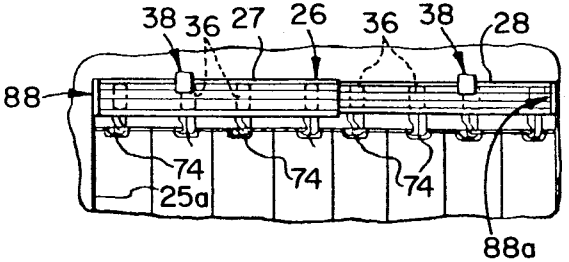
FIG. 1B is a partial vertical elevation showing an embodiment with two telescoping track sections.

The track sections 27 and 28 may be arranged in various forms and, for example, may be arranged in a system as illustrated in FIG. 1A wherein two sections 27 are provided with a connecting section 28 telescoped into the opposed ends of the sections 27. In the arrangement of FIG. 1A the drapery panels 22 are shown closed over an opening such as a window, generally designated by the numeral 25. Alternatively, the system may require the use of only one track section 27 and one track section 28, as illustrated in FIG. 1B, wherein the system is disposed across a window or opening 25*a*. Since one traverse rod 26 of a given nominal length is intended to fit an opening of variable width, consistent with the nominal size of traverse rod 26, track sections 27 and 28 should be telescoped by a suitable length of track, for example, four inches or more, when fitted to the maximum width opening. It is to be realized, however, that a non-adjustable-in-length traverse rod may be used in place of an adjustable traverse rod and the benefits of the present invention will still be obtained.

Figure 6:
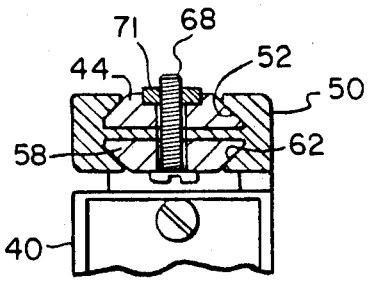
FIG. 6 is a detail section view taken along line 6—6 of FIG. 5.
Figure 4:
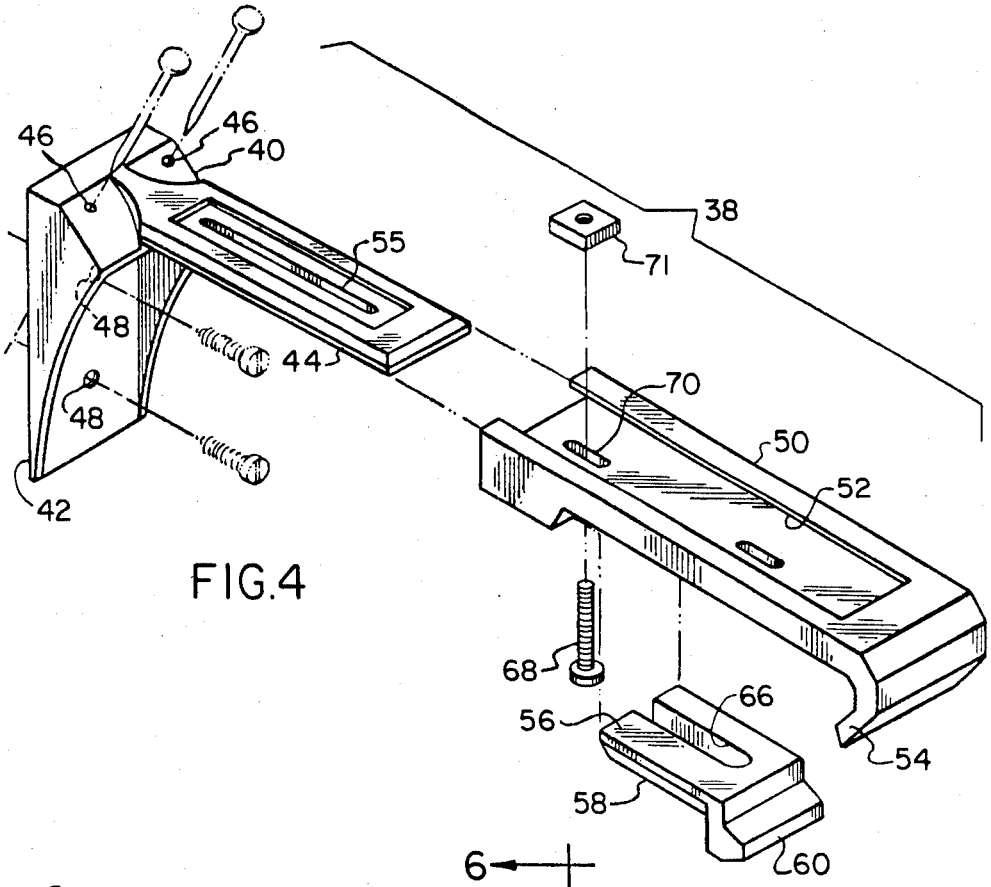
FIG. 4 is an exploded view of the components of one of the support brackets for the drapery support system of the present invention.

The traverse rod 26 is adapted to be supported by a plurality of spaced apart support brackets of unique configuration and generally designated by the numeral 38. Referring to FIGS. 4, 5, and 6, one embodiment of the support bracket 38 is adapted for vertical wall mounting and includes a base member 40 having a wall mounting surface portion with a planar surface 42. An elongated dovetail shaped beam portion 44 projects from the base member and includes an elongated slot 55 formed therein. The base member 40 preferably includes spaced apart angled holes 46 for receiving bracket supporting nails or the like. The base member 40 also typically includes spaced apart holes 48 to provide for alternative screw or nail mounting arrangements. The beam portion 44 is adapted to slidably receive a bracket member 50 having a dovetail groove 52 for receiving the beam portion and also having a downwardly depending angled flange portion 54 configured to fit within one of the recesses 30 or 30*a* of one of the respective track sections.

The bracket 38 includes a third member 56 including a dovetail portion 58 and a somewhat "vee" shaped projection 60 disposed at right angles to the longitudinal extent of the dovetail section. The bracket member 56 is adapted to be slidably fitted in a dovetail slot 62, see FIG. 6, formed on the bottom side of the bracket member 50 opposite the slot 52. An open ended or somewhat U shaped slot 66 is formed in the bracket member 56 for receiving a threaded screw 68 as illustrated in FIGS. 4 and 6. The screw 68 is adapted to project through a slot 70 formed in the member 50 and is engageable with a conventional nut 71, as shown. The screw 68 also projects through the elongated slot 55 formed in the beam 44. Accordingly, the position of the member 56 may be adjusted so that the track sections 27 or 28 are securely clamped between the flange 54 and the projection 60 and the members 50 and 56 may be selectively positioned in assembly along the beam 44 to position the traverse rod 26 with respect to the structure to which the brackets 38 are attached.

Figure 5A:
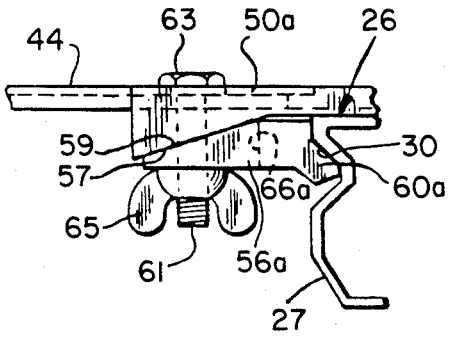
FIG. 5A is a detail view of an alternate embodiment of a support bracket arrangement.
Figure 5:
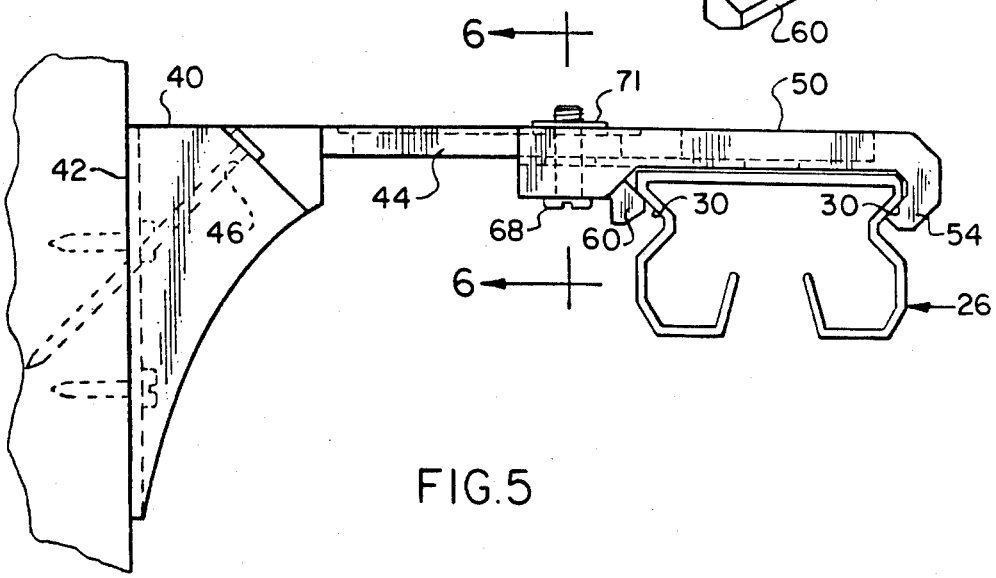
FIG. 5 is a side elevation showing the support bracket assembled and supporting a trackway.

A modified arrangement of the bracket members 50 and 58 is shown in FIG. 5A. The detail view of FIG. 5A shows a bracket member 50*a* having a sloping wedge surface 57 which is cooperable with a bracket member 56*a* having a complementary wedge surface 59. The bracket member 56*a* also includes a somewhat "Vee" shaped projecting portion 60*a* for engaging one of the recesses 30 or 30*a* in the tracks sections 27 or 28. The modified arrangement according to FIG. 5A includes a screw 61 having a head portion 63 and cooperable with wing nut 65. The screw 61 projects through the slot 55 in the beam 44 and is retained therein by the head portion 63. Upon tightening the wing nut 65, the member 56*a* is biased to move toward the recess 30 to grip the traverse rod 26 tightly, thanks to the movement of the member 56*a* relative to the member 50*a* caused by the cooperating wedge surfaces 57 and 59. Movement of the member 56*a* is also provided for by a slot 66*a* through which the screw 61 projects. Alternatively, the member 56*a* might be modified to include a spring coacting with an abutting surface on the member 50 so that the member is always biased to engage the traverse rod 26.

Although the traverse rod 26 may be mounted in various positions using the bracket assembly 38 the track sections 27 and 28 are also provided with a series of spaced apart holes 64, FIG. 1, whereby the track may be mounted directly to a ceiling member or other horizontally extending surface using conventional fasteners.

Referring again to FIGS. 1, 2 and 3, each of the drapery support slides 36 is characterized by oppositely projecting arms 37, FIG. 2, having sloping outer bearing surfaces 39 and downwardly facing bearing surfaces 41. The slides 36 also comprise a central downwardly projecting shank or hook support portion 43 having opposed sloping sidewall surfaces 5. The shank 43 is formed with a centrally disposed recess 47 forming opposed jaw portions 49. A conical projection 51 extends into the recess 47 and into a cooperating recess formed on a hanger hook member, generally designated by the numeral 74. The hook 74 includes a trunnion 76 adapted to fit within the recess 47 and including a depression for receiving the projection 51. The hook 74 is rotatable with respect to the slide member 36 to accommodate the angular movement of the pleats of the drapery panels, and the trunnion 76 may be proportioned to snap into and out of the recess 47 by slight deflection of the opposed jaw portions 49. The slide 36 is preferably molded of a suitable somewhat elastic material such as nylon or the like.

The slide member 36 is further characterized by a centrally disposed recess 53 opening upward towards the top web of the traverse rod 26. The recess 53 is dimensioned to receive an elongated elastically stretchable member 78 extending through the interior space formed by the traverse rod 26, FIG. 1, and pinched into the recesses 53 of each of the slides 36. The elastic member 78 is preferably formed of a homogeneous highly elastic material such as natural or synthetic rubber having a substantially uniform force-deflection characteristic along any portion of its length after being stretched taut. An important additional characteristic of elastic member 78 is its reduction in diameter as it is being stretched. This characteristic allows elastic member 78 to be attached to slides 36 wherein the opening or recess 53 within which elastic member 78 is to be inserted is smaller that both the relaxed diameter of elastic member 78 and the stretched diameter of elastic member 78 when stretched to the fullest extent allowed (when the drapery is fully closed). Further stretching of elastic member 78 further reduces its diameter then allowing it to fit into the smaller opening and be firmly attached thereto when, as explained, elastic member 78 is fully relaxed and even when it is stretched to the operational limits of its stretch (the maximum width of the opening). The elastic member may also comprise a flat elastic band or other equivalent means interconnecting the slides 36. Accordingly, by spacing the slides 36 equidistant along the elastic member 78, securing the slides to the elastic member, and by pulling the drapery panel 22 toward a closed position by moving the lead slide 36*a*, viewing FIGS. 1 and 1A, the elastic member 78 will stretch uniformly and the spacing between the slides 36 will remain substantially equal for each pair of slides whereby the folds or pleats in the drapery panel 22 will be extended or folded equally from the initial taut length of elastic member 78 to its stretched length when the draperies are fully drawn closed.

Figure 3:
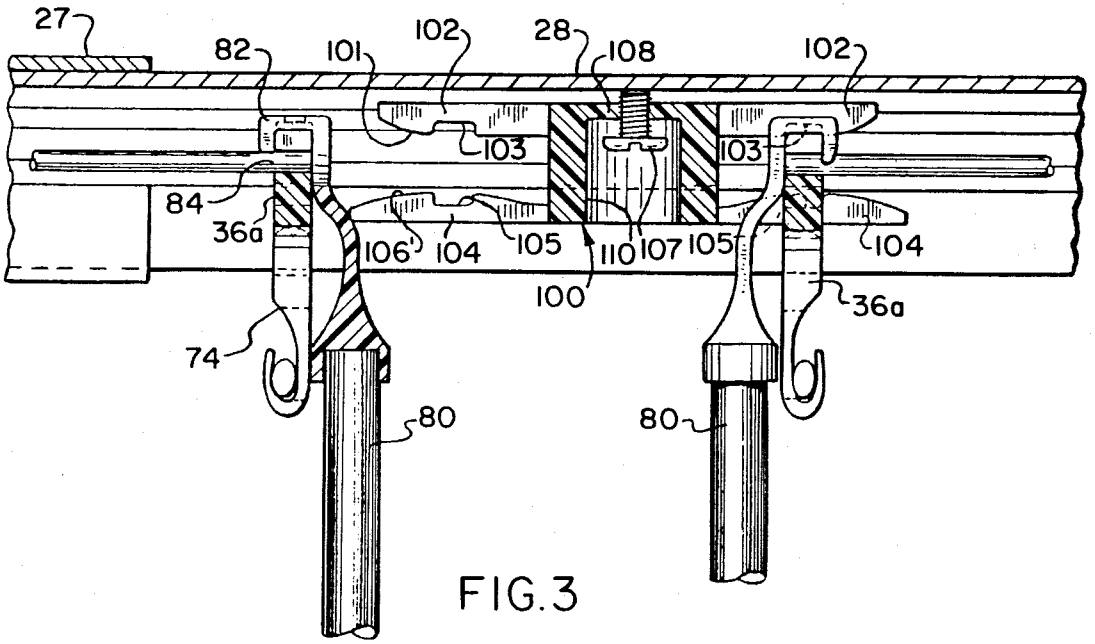
FIG. 3 is a side elevation, in section, of a double latch mechanism for a center or double draw drapery arrangement in accordance with the present invention.

Referring to FIGS. 1 and 3, the drapery support system 20 may also include a drapery panel traverse member comprising an elongated baton 80 having a hook portion formed at its upper end and characterized by a pair of opposed fingers 82 forming a recess therebetween. The fingers 82 are formed in a somewhat inverted U shaped configuration and are proportioned to hook over the opposed arms 37 of the slide 36*a*, for example. The fingers 82 are preferably formed with reentrant distal end portions 84, see FIG. 3, which are adapted to be nested in cooperating recesses formed in the arms 37. The baton 80 is also preferably formed of a molded resilient plastic material which will permit forcibly fitting the hook fingers 82 to the slide but also permitting disconnection of the baton from the slide.

Figure 9:
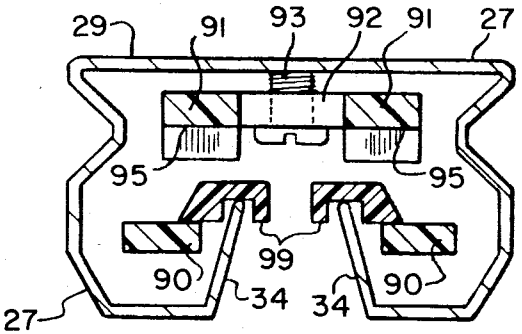
FIG. 9 is a section view taken along line 9—9 of FIG. 8.
Figure 8:
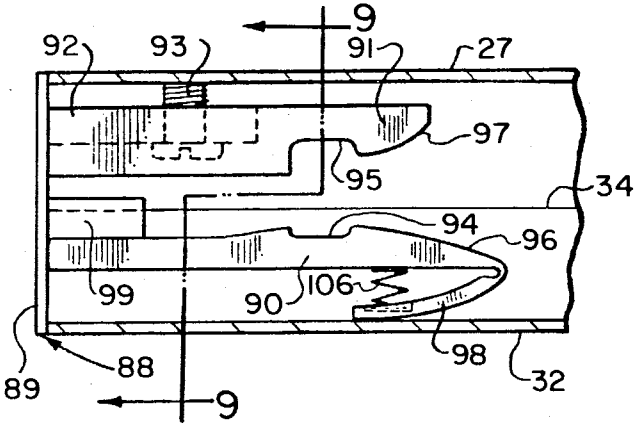
FIG. 8 is a side elevation, in section, of one of the end latch assemblies for the support system shown in FIG. 1.

Referring now to FIGS. 1, 8, and 9, there is illustrated an end cap and latch member 88 which is adapted to fit within the end of the inner or outer track section 27 or 28, as required. The end cap 88 is preferably proportioned to fit within the respective track sections with the same relative dimensional matchups and, accordingly, for an arrangement such as that shown in FIG. 1B a dimensionally modified end cap 88*a* is provided for track section 28. The end cap 88 includes a transverse end flange 89 and spaced apart horizontally projecting fingers 90 and 91. The fingers 91 are formed integral with a boss 92 having a locking screw 93 projecting therethrough and adapted to engage the web 29 or 29*a* of respective ones of the track sections to secure the end cap within the end portion of the track section. The fingers 90 and 92 are provided with transverse notches 94 and 95, respectively, and sloping cam portions 96 and 97 which are engageable with the arms 37 of a slide 36 to latch the slide between the fingers and lodged in the notches 94 and 95. The fingers 91 may be resiliently deflectable to permit forcible insertion and removal of the slide 36 with respect to the cooperating notches 94 and 95. Bracket portions 99 are formed adjacent the juncture of the fingers 90 and the flange 89 and are adapted to engage the flanges 34 or 34*a* of the track sections 27 or 28 to secure the end cap 88 to the track sections in response to tightening of the screw 93 against the top web 29. As shown in FIGS. 8 and 9, the fingers 90 extend within the spaces formed between the outer sidewalls of the track section 27 and the respective flanges 34. The fingers 90 are adapted to be deflected downwardly to accommodate movement of opposed cam surfaces 33 and 35 on the arms 37, FIG. 2, into the respective notches 94 and 95 in the fingers. The fingers 90 preferably include end portions 98 which are adapted to engage the bottom walls 32 or 32*a* of the track sections and to support coil springs 106 for biasing the fingers 90 upward, viewing FIG. 8.

Referring again to FIGS. 1 and 3, there is illustrated a latch member similar in some respects to the latch member and end cap 88 and adapted to be selectively positioned along the inside of the track sections 27 or 28 for use in conjunction with so-called two way or center draw drapery arrangements or the one way or side draw drapery. The latch member illustrated in FIG. 3 is generally designated by the numeral 100 and includes spaced apart oppositely projecting upper fingers 102 and lower fingers 104, respectively. The fingers 102 and 104 are each provided with latching recesses 103 and 105 for receiving the opposed arms 37 of a slide member 36*a*, as illustrated, for latching a slide member in the closed condition of the drapery panels 22. One or more latch members 100 may be selectively positioned along the inside channel space of either track section and may be locked into position by a set screw 107 threadedly engaged with a central web portion 108 and disposed in a recess 110. The web portion 108 is also provided with opposed grooves 111, FIG. 1, which are adapted to engage the flanges 34 or 34*a* in a manner similar to the manner in which grooves formed by the projections 99 on the end caps 88 are utilized. The fingers 102 and 104, are also provided with respective cam surfaces 101 and 106' which enhance the operation of moving the slides into and out of the latched condition with respect to the member 100. The fingers 104 are deflectable downward in response to a downward pulling action on a slide member 36 to release the slide member from its latched condition between the fingers 102 and 104 to permit opening movement of the panels 22. The fingers 102 and 104 could also be modified to omit the latching recesses in one or the other of the fingers to facilitate unlatching the slide members. The fingers 102 and/or 104 could also be modified to include biasing springs such as shown for the fingers 90 of the latch member 88.

When used with a one-way or side draw drapery arrangement, latch member 100 may be positioned on either end of the traverse rod and secured thereto by set screw 107. In this manner, latch member 100 will provide the same function as end cap 88. However, latch member 100 may also be positioned along any length of traverse rod 26. When so positioned, latch member 100 will allow a one-way drapery arrangement to be partially drawn closed to a predetermined position. The use of two separate latches 100 will provide a two-way drapery arrangement with partial drawing capabilities.

Figure 10:
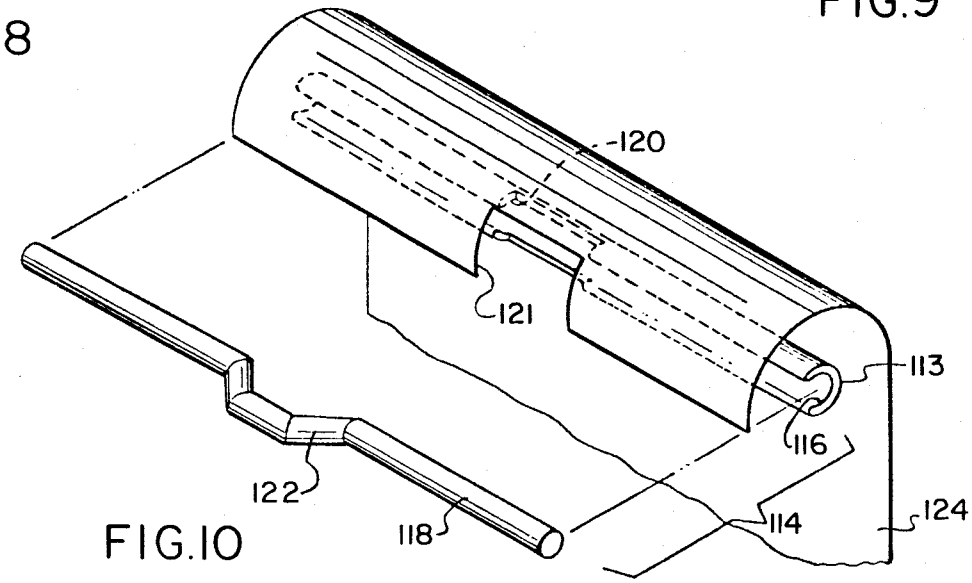
FIG. 10 is an exploded perspective view of a hanger assembly.
Figure 11:
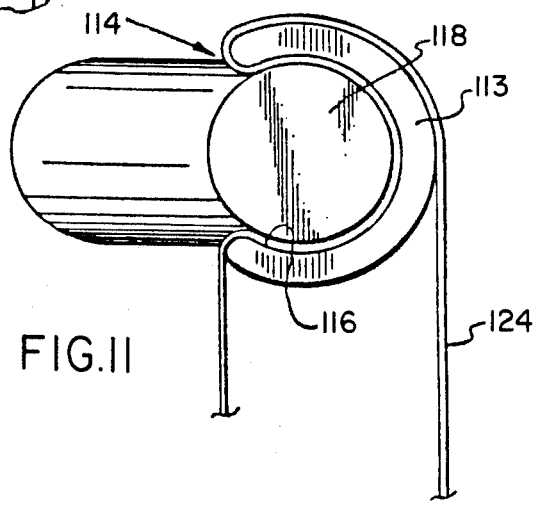
FIG. 11 is a side view showing the hanger in the assembled condition.

Referring now to FIGS. 10 and 11, there is illustrated one embodiment of an improved hanger assembly 114 for use in forming and supporting the individual pleats 24 of the drapery panels 22 or for supporting individual blind panels as the panel or segment 124 shown in FIGS. 10 and 11. The hanger assembly comprises an elongated semi-cylindrical tubular sleeve 113 having an arcuate recess 116 formed therein and adapted to receive a cylindrical hanger rod 118. The sleeve 113 is formed to provide for a snap action interference fit of the hanger rod into the recess 116, particularly when the upper end portion of the drapery panel is disposed in the recess as illustrated for the panel 124. The hanger sleeve 113 and rod 118 are both formed with respective relieved portions 120 and 122 to form a hook eye when the rod is assembled to the sleeve so that the hanger may be engaged with and suspended from one of the hooks 74. The edge of the panel 124 may be cut away at 121, as shown in FIG. 10, to enlarge the opening for the hook eye formed by the hanger assembly.

The hanger assembly 114 is particularly advantageous in that the height or vertical hanging length of a drapery panel may be adjusted by simply positioning the edge of the panel in relation to the recess 116 and inserting the rod 118 into the recess to clamp the edge of the pleat or fold of the panel as desired. The hanger sleeve 113 and rod 118 are also preferably formed of a resilient plastic material which is sufficiently rigid to support the folds of the drapery panel but which may permit the parts to be snapped into and out of assembly with respect to each other as described herein. The rods 118 may also be used alone by sewing them at spaced apart intervals into a hem 25, FIG. 2, formed along the upper edge of a panel 22.

Figure 7:
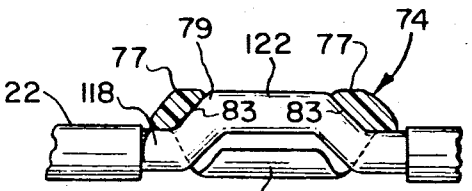
FIG. 7 is a detail section view taken along line 7—7 of FIG. 2.

Referring to FIGS. 2 and 7, the hook 74 includes downwardly depending opposed tines 77 forming an opening 79 therebetween. The tines 77 are integral with an upwardly projecting tang 81 which is adapted to snap over and secure the bent or relieved portion 122 of the hanger rod 118 in assembly with the hook. The tines 77 are formed with opposed flat surfaces 83 which bear against the opposed legs of the hanger rod portions 122 to maintain the hanger in the position shown in the drawing figures. The hook 74 is preferably formed or a resilient plastic material to permit deflection of the tang 81 for forcible snap insertion and removal of the hanger rod 118 into the secured position on the hook.

Figure 16:
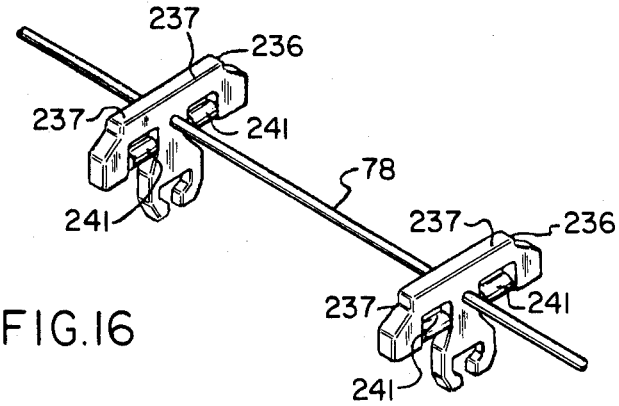
FIG. 16 is a perspective view of a modified slide member and elastic member arrangement for use with the embodiment of FIG. 1.

Referring briefly to FIG. 16, an alternate embodiment of slide members for use with drapery support system 20 is illustrated permanently attached to the elastic member 78. The slide members illustrated in FIG. 16 are designated by the numeral 236 and are generally of the same configuration as the slide members 36 with the exception that the slide members 236 are provided with opposed arms 237 which are adapted to include rollers 241 in place of the bearing slide surfaces 41. Accordingly, for use in drapery support systems of particularly great length or for supporting relatively heavy draperies the friction between the slides and the bearing surfaces of the flanges 34 and **34*a* may be reduced by using the slide and elastic member assembly illustrated in FIG. 16**.

It will be appreciated from the foregoing description of the components of the drapery support system 20 that a mechanically uncomplicated but highly advantageous system is provided which is easily assembled and adjusted for various span lengths which are to be partitioned or closed by a drapery panel or panels. The drapery support system 20 may be provided in various lengths of traverse rod 26 wherein the track sections 27 and 28 may be of substantially the same length and, accordingly, may be extended with respect to each other to cover a span of approximately 50% greater than the minimum span covered by a fully telescoped track assembly. By selection of the elasticity of the elastic member 78 one length of elastic member may serve both the minimum maximum span settings. When the desired span is selected, the track sections 27 and 28 are extended with respect to each other and mounted in the brackets 38 which, of course, would be previously located and secured to a wall or other supporting structure. By way of example, it may be assumed that a traverse rod and drapery arrangement sized between 36 and 54 inches is to be used to fit an opening of 48 inches, and that a two section traverse rod 26 is to be used. Each rod section may be of a length of approximately 30 inches which would give an overlap of at least three inches if the rod were to be fitted to a 54 inch width opening. This rod would fit the opening of between 36 inches to 54 inches. This variable width may be one of the nominal sized openings to which one nominally sized premanufactured set of draperies and traverse rods may be fitted. In this example, 5 pleats per side would be normally used. Thus, a total of ten pleats would be used. Further, the drapery may comprise either a center opening set of draperies, or a side opening single drapery. In the case of a single drapery, a total width of 90 inches to 108 inches drapery may be used (two 45 inch to 54 inch panels sewn together); or, in the double drapery arrangement, each drapery may have a width of between 45 inches to 54 inches. The elastic member 78 may have a length of approximately 22 inches and a fully stretched length of approximately 88 inches (400% expansion). Such an elastic member would therefore be stretched approximately 14 inches and 32 inches (250% expansion) with the minimum and maximum openings, respectively. The above example is, of course, only one example of the present invention being applied to a variably sized opening. Other nominally sized premanufactured sets of draperies fitting other variably sized widths of openings may be similarly sized.

After extension of the tracks and securement to the brackets 38 the slides 36 may be secured to the elastic member 78 at preset spaced apart intervals utilizing the aforementioned assembly technique. The slides 36 may be alternately preassembled to the elastic member 78 prior to packaging and shipment of the support system 20 or may be positioned prior to final assembly of the system. If a center pull arrangement is preferred utilizing two drapery panels 22 one or two latching members 100 may be located in the desired position within the channel space formed by the support traverse rod 26 and secured in place by the set screw 107.

After placement of the respective slides within the channels of the tracks the end caps 88 may be assembled to the track and secured thereto by the set screws 93. The end slide 36 may then be latched by the fingers 90 and 91. If the drapery panel 22 has not been previously secured to the hanger assemblies such may be done prior to securing the hangers to the hooks 74. The hooks 74 may then be inserted into the recesses 47 in the respective slide members 36 and the panel hung with the accordion fold type pleats as illustrated in FIG. 1. The batons 80 may then be attached to each of the opposed end slides **36*a*, as shown in FIGS. 1 and 1A, and the drapery assembly is ready for use. Thanks to the use of the uniformly extensible elastic member 78 a baton 80 may be used to move either or both of the drapery panels 22 toward a closed position by merely pulling on the baton to move the slide 36*a* towards the latch member 100. Movement of the slide member 36*a* will result in movement of respective ones of the slide members as the elastic member 78 is tensioned. Once the elastic member 78 becomes taut and undergoes elastic stretching the slides 36 will move uniformly relative to each other to provide even spacing between the folds or pleats 24. With the configuration of the hook 74 the pleats or folds 24 are allowed to assume a substantially zig-zag or accordion fold configuration since the hooks 74 are pivotable with respect to the respective slide members 36**.

If a single draw or single panel drapery is utilized, the center latch member 100 having only one upper and one lower finger, 102 and 104, may be used in place of one of the end caps 88 are utilized to latch the end slides 36. Accordingly, one of the end caps 88 may be substantially permanently secured to an associated slide member 36 if a baton 80 is connected only to the opposite end slide. On the other hand, batons may be secured to both of the end slides so that the drapery can be drawn from either end of the support system. The slides 36 are easily traversed along the track sections 27 and 28 and are centralized or guided by the sloping surfaces 49 which engage the outwardly facing surfaces of the flanges 34 of the track section 27 or opposed surfaces 131 on the arms 37 are engageable with the inner surfaces of the flanges 34*a*. Accordingly, regardless of which track section the slides are traversing, since the clearances between the surfaces 45 and 131 and their cooperating bearing surfaces on the track sections 27 and 28, respectively, are equal, the slides are substantially centrally guided regardless of which track section they are traversing.

Figure 29:
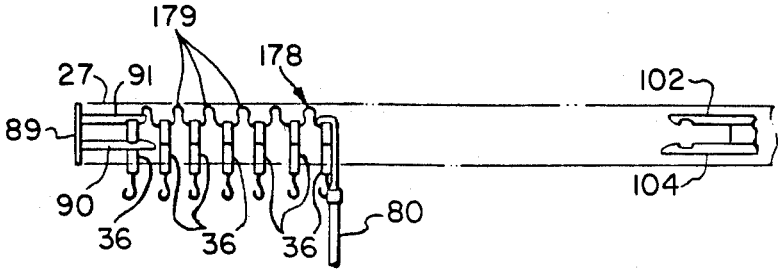
FIG. 29 is a side view in somewhat diagrammatic form showing an embodiment of an elastic member connected to a series of slides in the stacked back position.
Figure 30:
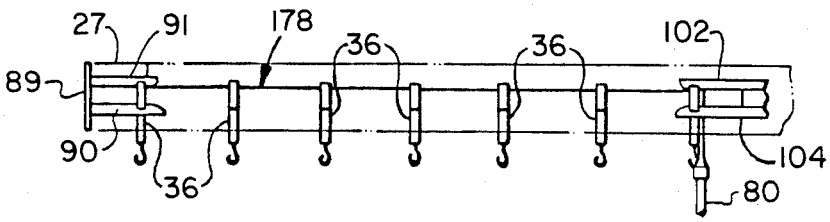
FIG. 30 is a schematic representation showing the elastic member and slide arrangement of FIG. 29 in a stretched condition.

Referring to FIGS. 29 and 30, a preferred arrangement of the slides 36 in combination with the traverse rod 26 and an elastic member interconnecting the slides is illustrated in somewhat schematic form in the stacked back and stretched condition, respectively. The elastic member interconnecting the slides 36 according to the embodiment of FIGS. 29 and 30 is generally designated by the numeral 178 and also includes a plurality of folds or loops 179 which are premolded into the elastic member 178 such that in the relaxed condition of the member the loops project upwardly, as shown in FIG. 29. Accordingly, in the stacked back position of the slides 36, the space between the slides may be minimized by the formation of the loops 179 to project upwardly and out of sight against the web 29 of the track 37. In the stretched condition of the slides 36, as indicated in FIG. 30, the loops 179 disappear and the elastic member 178 is stretched in a generally linear manner to provide substantially equal spacing between the slides 36.

As opposed to the arrangement illustrated in FIG. 30, the elastic member 78 may be pinched into the recesses 53 in the slides 36 in such a way that there is a tendency for the member 78 to bulge or deflect generally upward into the interior space formed by the track sections 27 and 28 when the drapery panels are moved to a stacked back condition to minimize the space occupied by the slides and the interconnected elastic member.

Figure 34:
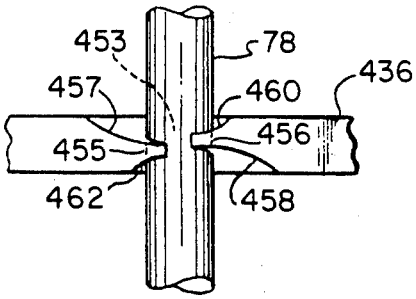
FIGS. 33 and 34 illustrate details of an alternate arrangement of the slides and an elastic member.
Figure 33:
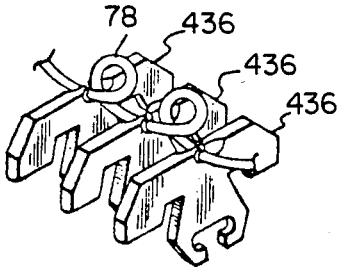

Yet another embodiment of the slide and elastic member configuration is illustration in FIGS. 33 and 34. Referring to FIG. 33 there is illustrated a modified version of the slide member 36 and designated by the numeral 436. The slide 436 is substantially identical to the slide 36 except the central notch for receiving the elastic member has been modified to provide for tightly pinching the elastic member to force the elastic member to curl or coil in a manner similar to the configuration of a helical coil spring when the elastic member is in the unstretched condition. As illustrated in FIG. 34, the slide 436 includes a central notch 453 which is defined by somewhat offset jaw portions 455 and 456 (a leading edge effect). The jaw portions lie adjacent to opposed scalloped recesses 457 and 458 which are offset with respect to the axis of the notch 453 so that respective sidewalls 460 and 462 of the recesses 457 and 458 bias the elastic member 78 in opposite directions. Moreover, the cross-sectional area of the notch 453 is relatively small and requires that the elastic member 78 be stretched rather tightly in the immediate area of the elastic member that is disposed in the notch. The slides 436 are, of course, selectively spaced along the elastic member in its unstretched condition. The elastic member is then stretched in the immediate vicinity of the point to be attached to the respective slides and inserted in the notch 453 for tight gripping engagement. The deflection of the elastic member caused by the leading edge effect of sidewall portions 460 and 462 of the respective recesses is such that in the relaxed condition the elastic member tends to form the helical coiled configuration illustrated in FIG. 33. In this way, when the slides 436 are in the stacked back position of a drapery panel, the elastic member length in between slides will relax into the upwardly coiled configuration to permit close spacing of the slide members and to prevent the elastic member portions in between slide members from drooping downwardly to become visible under the support track.

Referring now to FIGS. 35, 35*a*, 35B, 36, 36*a*, 37 and 37*a*, alternate embodiments of the concept of FIGS. 33 and 34 are schematically illustrated therein. All of these embodiments contemplate the use of a slide 350 which is firmly attached to the elastic member 78 but pivotally attached to a drapery whereby the vees or the pleats of the drapery may be extended out or gathered in, such as when the drapery is being drawn closed or opened, respectively. One type of such a slide 350 may be seen in FIG. 2, Item 36, but the portion whereby the slide 36 is attached to elastic member 78 (i.e. recess 53) may be replaced by the attachment structure (351 and 352) shown in FIGS. 35 through 37 as an integral part of slide member 350.

Figure 35:
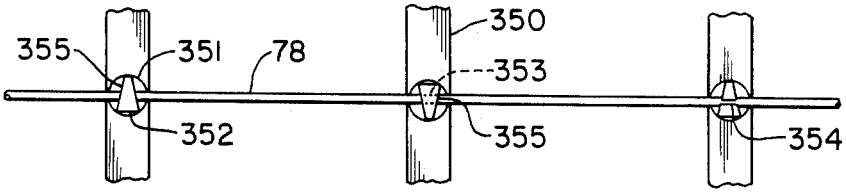
FIG. 35 is a top view of axially spaced hanger attachment fittings shown attached to the elastic member of a drapery support system of the present invention.
Figure 35A:
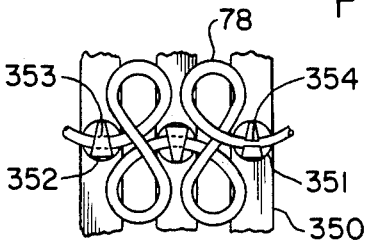
FIG. 35A schematically illustrates the gathering of the elastic member as provided by the fittings and apparatus of FIG. 35 when the drapery is fully opened.
Figure 35B:
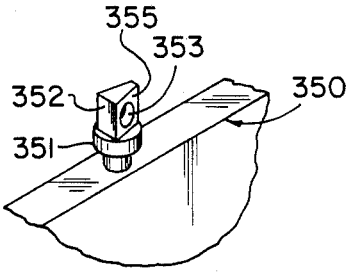
FIG. 35B is a schematic rendering of one of the fittings of the embodiment of FIG. 35.

Referring more particularly to FIGS. 35 and 35B, the apparatus means to attach elastic member 78 to side 350 may comprise a cylindrical base portion 351 and an attachment portion 352 having a through opening 353 or a slotted opening 354 provided perpendicular to the longitudinal axis of slide 350. Elastic member 78, as explained above, is force fitted or tightly pinched (due, in part, to the ability of elastic member 78 to be elastically reduced in diameter) within openings 353 or 354 so as to fixedly attach and position elastic member 78 to slides 350. The attachment portion 352 includes angled faces 355 which when viewed from above appear similar to a truncated triangle. Since the opening 353 or slotted opening 354 are provided at right angles to the axis of the slides 350, the faces 355 are angled relative to elastic member 78 such that one side or edge of opening 353 or 354 is leading relative to the opposite side or edge. The leading edge feature, which is reasonably obvious in the top view shown in FIG. 35, serves to bias the elastic member 78 in a rotational direction toward the nonleading edge when elastic member 78 is in an unstretched posture. By arranging each slide 350 such that adjacent slides 350 have the leading edges positioned on opposite sides of elastic member 78, elastic member 78 will achieve a coiled position as illustrated in FIG. 35*a* when the draperies are fully open (when the pleats are gathered against each other). Portions of slide 350 are not shown in FIG. 35*a* for purposes of clarity of illustration. By biasing elastic member 78 in this manner, the elastic member length between slides 350 will relax into the position shown permitting very close spacing of the pleats and preventing the elastic member from orienting itself in an unknown position which could then cause interference between slides 350 and uneven gathering of the drapery panels.

Figure 36:
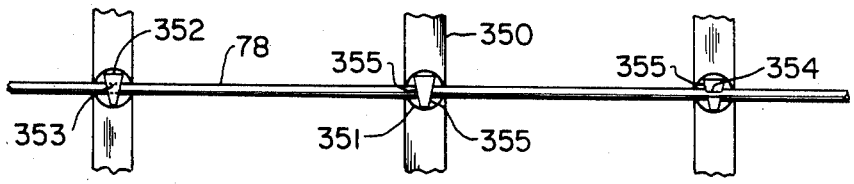
FIG. 36 is a top view of another embodiment of gathering fittings applied to an elastic member.
Figure 36A:
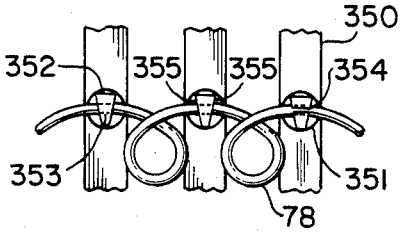
FIG. 36A is a top schematic view of the gathered elastic member as provided by the fittings and apparatus of FIG. 36 when the drapery is substantially fully open.

In FIG. 36, the same type and configured slides 350 and attachment structure comprising base portion 351 and attachment portion 352, as those of FIG. 35, are used but with the leading edges 355 of attachment structures 351 and 352 all facing in the same direction and located on the same side of elastic member 78. This arrangement will result in a helical coil configuration as shown in FIG. 36*a* which is similar to that of FIG. 33. The same close spacing and known location of coiled elastic member 78 is again achieved.

Figure 37A:
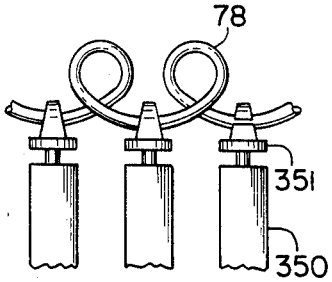
FIG. 37A is a schematic view of the gathered elastic member as provided by the fittings and apparatus of FIG. 37 where the drapery is substantially fully open.
Figure 37:
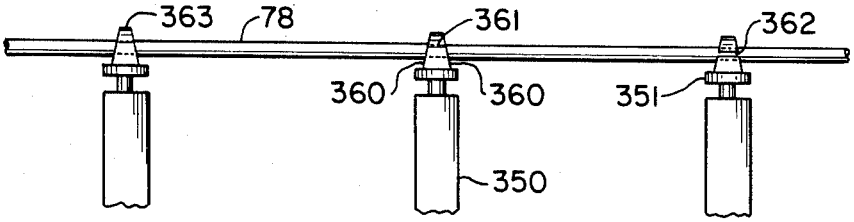
FIG. 37 is yet another embodiment of gathering fittings and apparatus attached to an elastic member.

The arrangement of FIG. 37 illustrates yet another embodiment of the leading edge concept. In this arrangement the angled faces 360 of attachment portion 363 point vertically upward from cylindrical portion 351. The previously shown and explained through openings 361 or slotted openings 362 may be used to affix and locate elastic member 78 to slides 350. When the drapery panels are gathered against each other, the leading edge effect of sides 360 cause elastic member 78 to loop upwardly above slides 350 in either or both of the configurations schematically shown in FIG. 37*a*.

Figure 39:
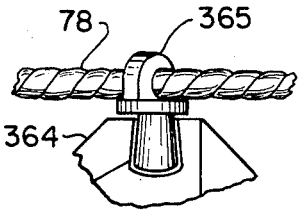
FIG. 39 is a schematic rendering of one of the gathering fittings of the embodiment of FIG. 38.
Figure 38:
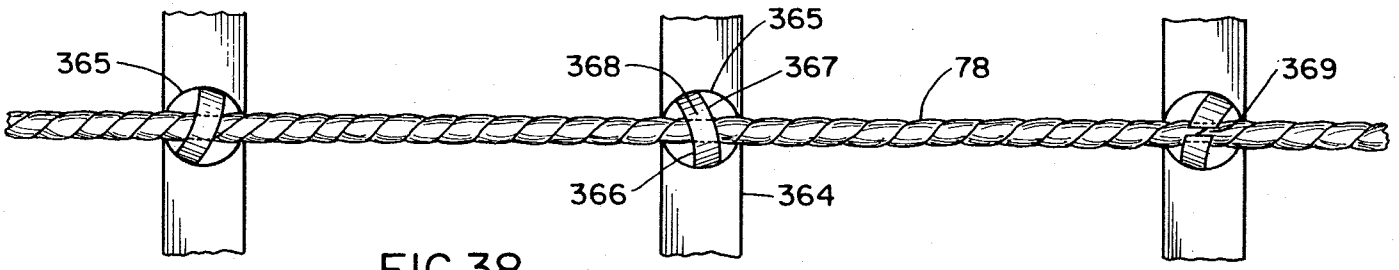
FIG. 38 is still another embodiment of gathering fittings and apparatus attached to an elastic member.

Yet another embodiment of the leading edge concept is illustrated in FIG. 38. In this arrangement, the apparatus means used to attach slide 364 to elastic member 78 is rotationally attached to the main body of slides 364 such as that shown in FIG. 39 and such that a slight amount of pivoting motion is obtained. Attachment portion 365 may be attached to slide 364 in the manner shown in FIG. 15 and explained hereinafter so that the appropriate relative motion between slides 364 and the attachment portion 365 is achieved. Additionally, slides 364 are rotationally attached to the top edge of respective pleated drapery panels. The rotational motion may be achieved by the arrangement described in FIG. 2 but with the use of hook 74 to attach slides 364 to the pleated drapery being optional or replaced by any conventional method. Another satisfactory rotating attachment is shown in FIG. 41 where upper or first rotation is achieved by member 365 and lower or second rotation is achieved by conical end 376 being fitted to member 377 which may be attached to the top of the drapery panel in any well known manner.

Figure 40:
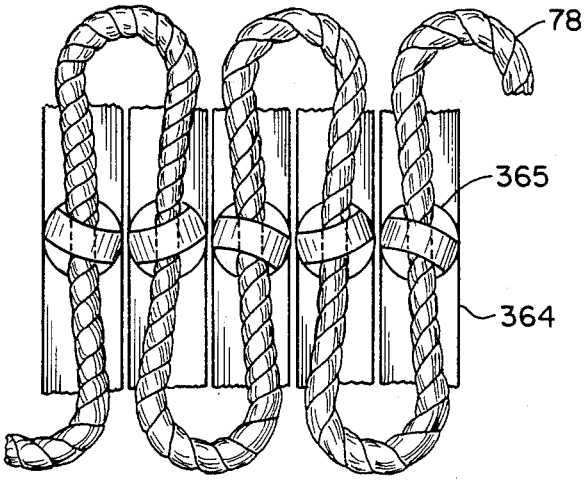
FIG. 40 is a schematic view of the gathered elastic member as provided by the fittings and apparatus of FIGS. 38 and 39 when the drapery is substantially fully open.

Referring again to FIGS. 38 and 40, it may be seen that the faces 366 and 367 are angled relative to the longitudinal axis of slide 364 and elastic member 78 but are parallel to each other. This alignment is automatically achieved because of the angled orientation of faces 366 and 367 relative to through opening 368 or slotted opening 369 in attachment portion 365, as shown in FIG. 38. Again, as above, either slotted opening 369 or through opening 368 may be used to pinch or forcefully fit elastic member 78 to attachment portions 365 of slides 364. In FIG. 38 it is seen that each attachment portion 365 is oppositely oriented relative to adjacent attachment portions 365. This orientation is necessary to achieve the gathering of elastic member 78 as shown in FIG. 40.

The alternating orientation of attachment members 365 positions the leading edges of adjacent pairs of attachment members 365 first in a horizontally rearward posture then a horizontally forward posture, which is repetitive, relative to an installed traverse rod and draperies. This orientation results in the gathering or coiling of elastic member 78 as shown in FIG. 40 when the drapery is fully gathered or open. The rotational abilities of slides 364 relative to attachment portion 365 and the top 377 of the draperies are, of course, instrumental in achieving the shown and described coiling of elastic member 78. This arrangement positively allows close spacing of the slide members (and the pleated drapery panels) and prevents the elastic member portions between slide members from interfering with the opening of the draperies.

Figure 41:
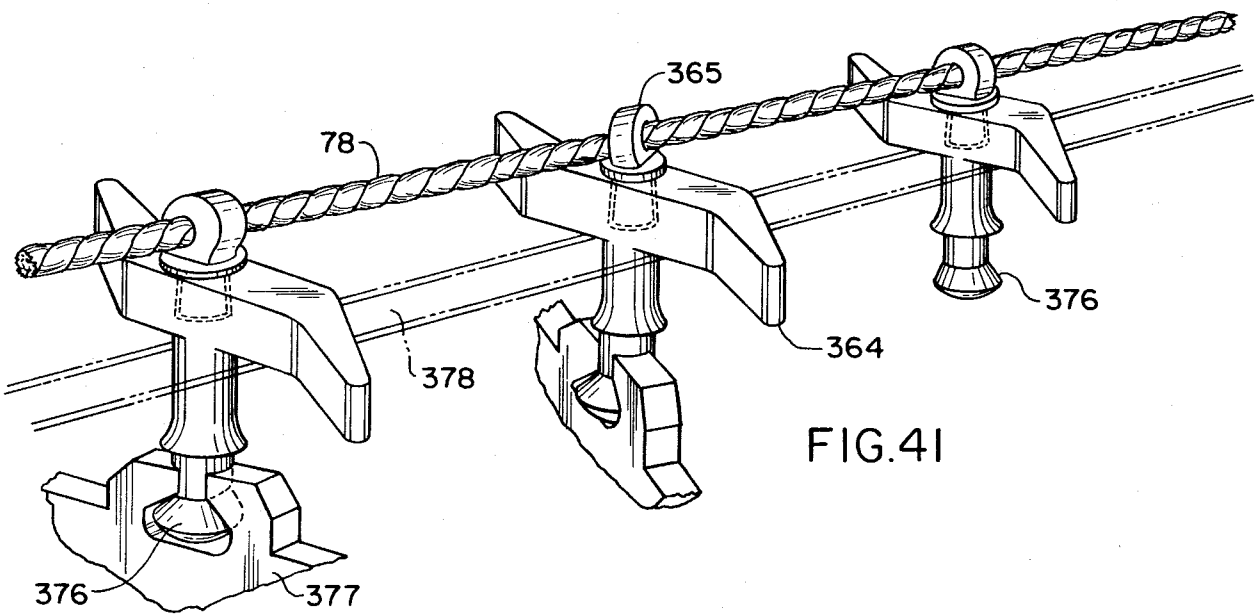
FIG. 41 is an isometric rendering of one preferred embodiment of slide members shown attached to the fitting of FIG. 39 and pleated drapery panels.

In FIG. 41 there is illustrated a preferred embodiment of slide members 364 which are shown in conjunction with attachment members 365. Moreover, the non-rotational attachment portions 352 may also be used with this embodiment of slide members 364. Slides 364 each comprise an "S" shaped member which allows for close stacking and yet prevents the slides 364 from falling through opening 378 which opening may comprise, for example, the central opening of the track formed between opposed flanges 34 of the traverse rod 26 of the embodiment of FIG. 1.

Figure 31:
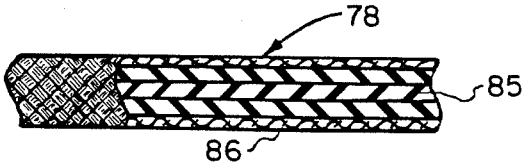
FIG. 31 is a detail view of a preferred embodiment of the elastic member.

Elastic members 78 and 178 may also be formed in such a way as to have stretch limiting means so that, for example, the elastic member will expand to no more than two and one-half times its relaxed or untensioned length. In the unlikely event that if one or more of the slides 36 stick on the track, or the friction of the multiple stacked back slides is relatively great, a segment of elastic member between slides will not continue to stretch and increase the distance between two adjacent pleats but a maximum spacing between pleats will occur. Referring briefly to FIG. 31, there is illustrated a detail view of a preferred construction for the elastic member 78. For example, the elastic member 78 may be formed with a core of a single or plural strand 85 of elastic material such as natural or synthetic rubber surrounded by a braided or woven sheath or jacket 86. The sheath or jacket 86 may be tightly braided or woven over the core member or may be molded to or adhered to the core by a suitable adhesive. The fabric sheath or jacket forms a casing which limits the stretchability of the core member 85 and also provides a wear resistant cover for the elastic member 78. Accordingly, the provision of the braided or woven sheath will limit the stretchability of the elastic member so that the spacing between slides 36 will achieve a minimum extended spacing but will not exceed a maximum spacing which, as previously mentioned, corresponds to a preferable operating range of approximately 1.5 to 2.5 times the relaxed length of the elastic member. However, prototype testing has shown that an extendible minimum length of approximately 1.25 times the relaxed length will still operate satisfactorily. Also, that an extendible maximum operating length of approximately 3.5 times the relaxed length will operate satisfactory. Without the sheath or jacket 86, elastic member 78 should have an approximately elastically stretchable limit of at least four times it relaxed length. Should an elastically stretchable member having an upper stretchable limit exceeding four times its relaxed length, the preferred and upper operating limit may be appropriately extended. The construction of the elastic member illustrated in FIG. 31 may be similar to a stretch elastic of a type manufactured by Bungee International Mfg., Corp., Chatsworth, Calif.

Figure 14:
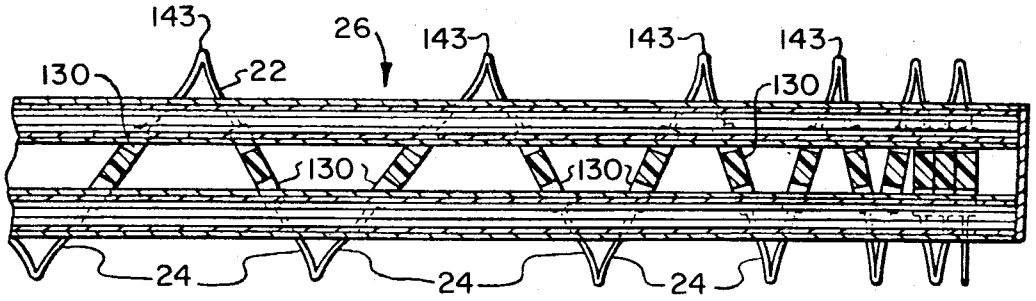
FIG. 14 is a section view in somewhat schematic form taken from the line 14—14 of FIG. 12 showing the spacing of pleats for a drapery panel having a permanent pressed elastic member memory.
Figure 12:
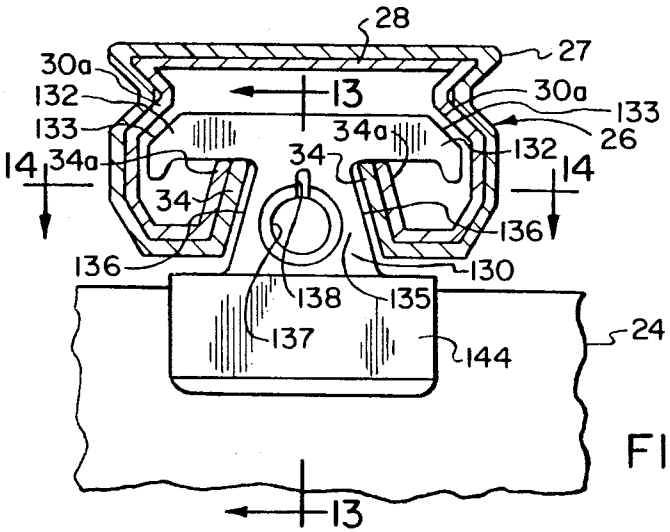
FIG. 12 is a transverse section view of a first alternate embodiment of the present invention.
Figure 13:
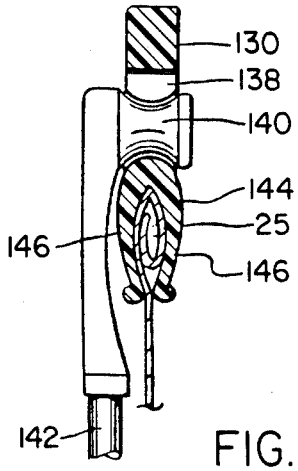
FIG. 13 is a section view taken along the line 13—13 of FIG. 12.

Referring now to FIGS. 12, 13, and 14, there is illustrated an alternate embodiment of the present invention wherein the track configuration 26 or a smaller scale version thereof is used in conjunction with a series of slides 130 which are provided with integral hanger portions and are usable with lightweight draperies. The stiffness or elastic member memory of the drapery fabric, such as provided by polyester fabrics having permanent pressed pleating, is sufficient to maintain equal spacing between the pleats in either the stacked back or a selected extending position. The slide 130 includes opposed arms 132 having sloping side surfaces 133 which are engageable with the cooperating sloping portions of the track sidewalls forming the recesses 30*a* for guiding the slide when it is traversing the track section 28. The slide 130 also includes an integral depending center shank portion 135 which extends between the opposed flanges 34 and is provided with side surfaces 136 which are engageable with the flanges 34 to guide the slide along the track section 27. The slide member 130 is provided with a generally circular opening 137 having a radially projecting slot portion 138 extending therefrom and adapted to receive a head portion 140 of an elongated baton 142, FIG. 13. The head 140 is adapted to be snapped into and out of engagement with the slide 130 for attaching the baton to a selected one of the slides, preferably at an end pleat or fold of a drapery panel.

As illustrated in FIGS. 12 and 13, each slide 130 is also provided with an integral hanger portion 144 characterized by opposed lips 146 which are configured to form a space therebetween for receiving the upper transverse edge or hem of a drapery pleat 24. The lips 146 are preferably fabricated or molded integral with the one-piece slide member 130 and are formed of an elastic member material which allows deflection of the lips away from each other to insert the edge of the pleat 24 into the hanger portion for retention thereby. With the configuration of the hanger portion 144 it may be preferable to form the hem 25 of the pleat 24 by folding the edge of the fabric over several times, as shown in FIG. 13, or sewing a strip of basting or elasticizing into the hem to thicken the hem and thereby facilitate retention in the hanger portion 144. With the arrangement of slides 130 the end slide adjacent to an end cap 88 may be snapped into the secured by the opposed fingers of the cap and the opposite end slide 130 is, of course, preferably secured to a baton 142. Since the slides 130 do not have a separate pivotally mounted hanger portion the slides themselves are adapted to rotate about their central vertical axes within the channels formed by the track sections 27 and 28; however, the amount of rotation normally does not exceed 45 degrees, depending on the amount of extension of the drapery panel. The slide members 130, as mentioned previously, would normally be used in conjunction with relatively lightweight draperies which have a certain degree of resiliency or elastic member memory which tends to maintain them in a folded or stacked condition.

Referring particularly to FIG. 14, a drapery panel 22 is shown which is formed of a fabric such as a woven polyester permanently pressed at creases 143 and wherein the drapery material has a sufficient elastic member memory to allow the pleats 24 to stack back into the configuration shown to the right, viewing FIG. 14. Upon drawing the drapery panel 22 to the left, the pleats 24 will become substantially evenly spaced as the slides 130 are intended and are allowed to rotate about their central vertical axes. Accordingly, a drapery panel 22 with pressed creases 143 is effective to evenly space itself as it is drawn between a stacked back condition and an extended condition as the elastic member memory of the drapery material performs the function of the elastic member 78. The material used for the drapery panel 22 in FIGS. 12 through 14 may be one of several synthetic or blended fabrics which have been permanently pressed or heat set to form the creases 143.

Figure 15:
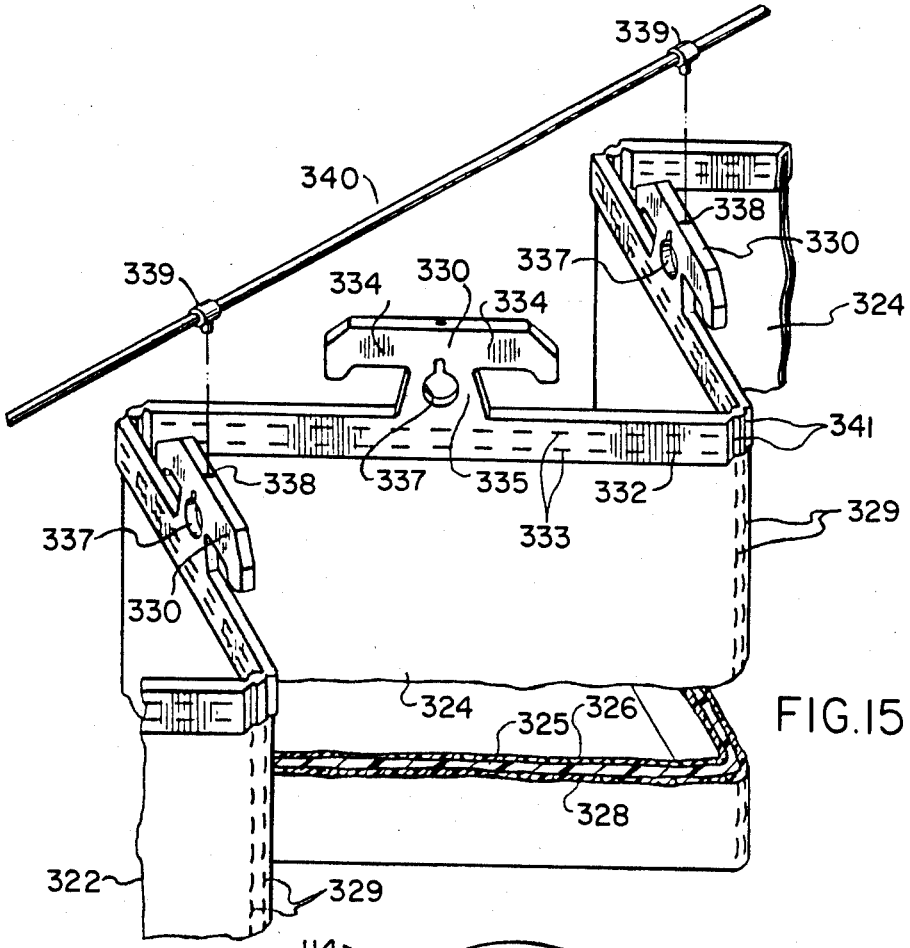
FIG. 15 is a perspective view of a second alternate embodiment of the present invention.
Figure 15A:
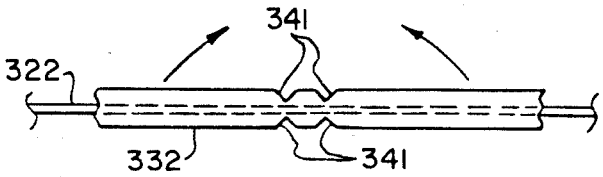
FIG. 15A is a detail plan view of the hanger portion of the system shown in FIG. 15.

Referring now to FIGS. 15 and 15A, yet another embodiment of a drapery support and traverse system is illustrated wherein slide members are formed as a continuous member including the hanger portion secured to the respective drapery panels. FIG. 15 illustrates a representative number of slide members 330 which are integrally formed with a hanger portion 332. The slide members 330 include opposed arms 334 and integral central shank portions 335 each provided with a baton receiving opening 337. The top horizontal surfaces of the shank portions 335 are each provided with a centrally disposed bore 338 for receiving a trunnion 339 connected to an elongated elastic member 340.

The continuous hanger portion 332 is formed at spaced apart intervals with closely spaced and parallel V-shaped notches 341 to provide hinges for folding the hanger portion with respect to itself at predetermined intervals corresponding to the width of pleats 324 for a drapery panel 322. The continuous hanger portion 332 may be formed as a somewhat inverted U-shaped or channel shaped member into which the upper edge of the drapery panel 322 may be inserted and secured thereto by a suitable adhesive or by double stitching indicated at 333 in FIGS. 15 and 15A. The integral slide and hanger assembly 330–332 may be formed of a suitable molded plastic and the wall thickness of the hanger portion 332 may be such as to provide for suitably sewing the upper hem or edge of the drapery panel 322 into the slot formed by the channel shaped configuration of the hanger portion. The "Vee" shaped notches or scored portions 341 permit easy folding of the continuous hanger portion 332 at the pleat folds of the panel 322. Additionally, the drapery panel 322 may be formed of various fabrics preferably including, for example, a Kodel brand filling material 325 sandwiched between two fabric layers 326 and 328 which are bound along the edges and are sewn at the folds forming the pleats 324 as indicated by the double stitching 329. The trunnions 339 may be inserted in alternate ones of the slide members 330 or any selected number of evenly spaced members. Since the slide members are a continuous strip formed by the integral hanger portion 332, there is a tendency for the panel to maintain an even fold spacing which probably does not require connection of the elastic member 340 to each of the slide members 330.

Figure 17:
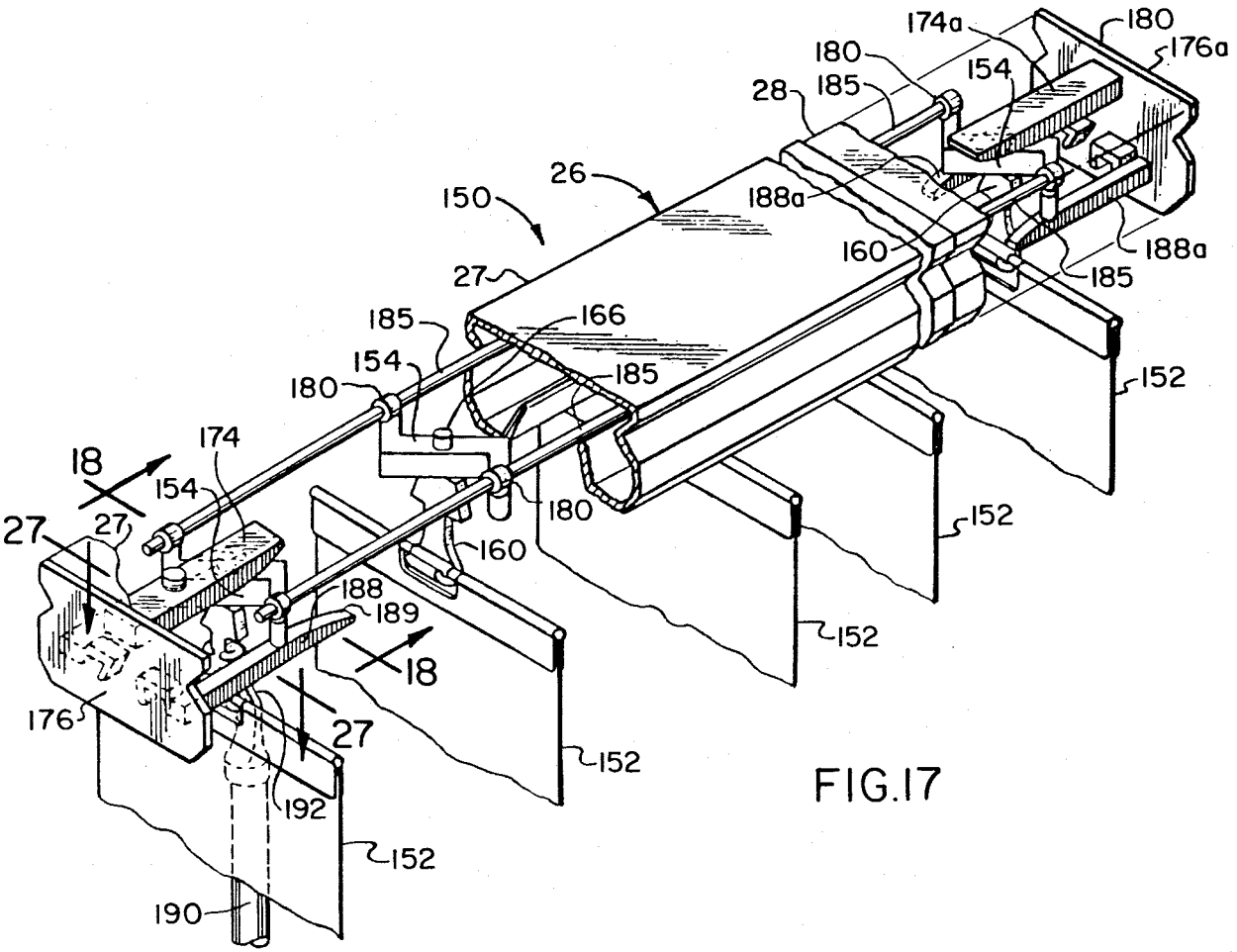
Figure 18:
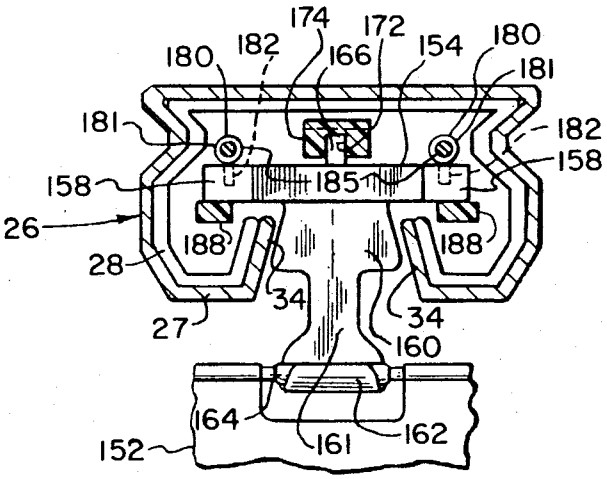
FIG. 18 is a section view taken along the line 18—18 of FIG. 17.
Figure 19:
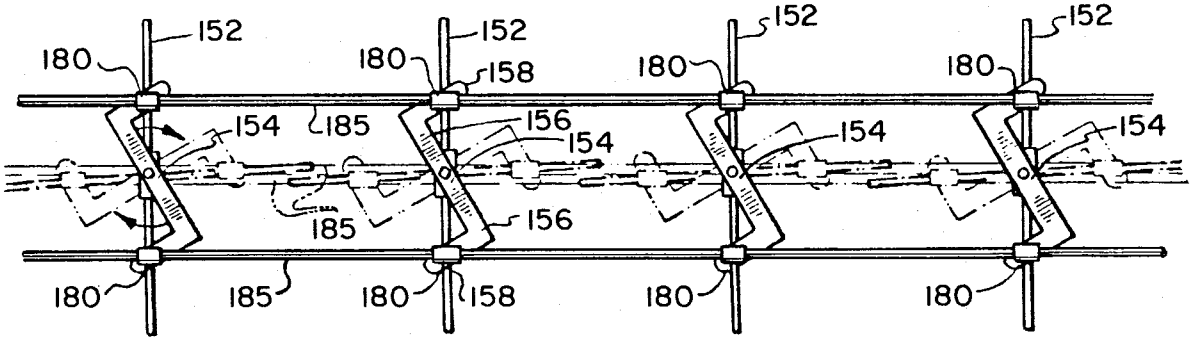
FIG. 19 is a diagram showing the closure movement of the slide members of the system of FIG. 17.

Referring now to FIGS. 17, 18, and 19, there is illustrated an improved support system for supporting vertical blind closures or the like, said support system being generally designated by the numeral 150. The support system 150 preferably utilizes a traverse rod 26 for supporting a plurality of vertical blind segments or slats 152. The blind segments 152 are adapted to be traversed from a stacked back condition directly adjacent each other to a traversed or extended condition and also rotated from a position wherein the plane of the blind segments extends perpendicular to the direction of traverse to a position wherein the slats extend generally parallel to the direction of traverse to form a closure. Each of the segments 152 is adapted to be suspended from a slide member 154 including a portion forming opposed radially extending arms 156. The arms 156 have distal end portions 158 extending at an angle with respect to the main portion of the arms as shown in FIG. 19. The slide members 154 each include a downwardly depending shank portion 160 having an integral hook 162 for receiving an hanger rod 164 similar to the hanger rod 118. In fact, a hanger assembly 114 may be used in conjunction with the slide member 154 or a rod member 118 or 164 may be sewn into a hem of the blind segment 152 depending on the material of which the blind segments are formed. The sides 154 each include an upwardly projecting central trunnion 166 which is adapted to be received in a recess 172 formed in a latch finger member 174 which may be formed as a separate member secured to the inside surface of the top web of one of the track sections 27 or 28 at a preselected point thereon. Alternatively, the latch member 174 may be integrally formed with an end cap 176 similar to the end cap 88. A substantially identical latch member and end cap 174a–176a is disposed at the opposite end of the assembly illustrated in FIG. 17.

The distal ends 158 of the arms of the slide members 154 are each adapted to receive respective swivel members 180. The swivel members 180 each comprise a shank or trunnion portion 182, FIG. 18, adapted to be pivotally supported in a cooperating bearing bore formed in each of the arm portions 158. The swivel members 180 include a body portion 181 having a bore therein for receiving an elastic member 185 similar to the elastic member 78. The swivel members 180 may be formed of a suitable material adapted to undergo plastic deflection whereby the bodies may be crimped to grip the elastic member 185 at predetermined points therealong for positioning the slide members 154 according to a predetermined initial spacing when the elastic member is in a relaxed condition.

The latch members 174 and 174a may be provided at opposite ends of the traverse rod 26 in the configuration shown as part of the end caps 176 and 176a. One or the other of the end slide members 154 is preferably permanently latched to the latch member 174 by insertion of the projection 166 into the recess 172. The end slide member is preferably biased in the latched position by axially projecting resilient fingers 188 which are engageable with the bottom side of the arms 156 for biasing the slide member 154 upwardly as the projection 166 engages the distal end of the latch member. The fingers 188 and 188a may be formed integral with the respective end caps 176 and 176a in a manner similar to the construction of the end cap 88 illustrated in FIG. 8. The fingers 188 also have sloping cam surfaces 189 which allow the end slide member 154 to ride up slightly on the fingers and clear of the bearing support edges of the flanges 34 and 34a so that adequate vertical clearance is provided for deflecting the fingers to unlatch the slide member.

Figure 27:
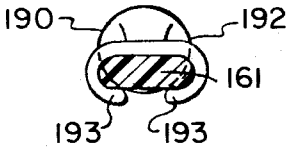
FIG. 27 is a section view taken along line 27—27 of FIG. 17.

The drapery support system 150 is also provided with a baton 190 adapted for use in traversing the blind segments 152 along the traverse rod 26 as well as rotating the blind segments between an open and closed position or any selected position therebetween. The baton 190 includes a hook portion 192 formed with opposed spreadable jaws 193, FIG. 27, which are configured to be disposed around the lower portion 161 of shank 160 in gripping engagement therewith. The cross-sectional configuration of the shank portion 161 is such as to provide a non-rotatable interlocking fit within the recess of the hook portion 192 formed by the opposed jaws 193 whereby the baton is adapted to clip securely to one of the end slide members 154, for example. A baton 190 may, of course, be clipped to either or both of the end slide members 154. By pulling downwardly on the baton 190 the fingers 188 or 188a may be depressed sufficiently to allow the trunnion 166 to be removed from the recess 172 whereby the blinds may be traversed from a closed to an open position stacked closely adjacent to each other. By rotating the baton 190 the slide member 154 connected to the baton is rotated to also effect rotation of all of the slide members thanks to the interconnecting elastic member 185. Since the elastic members 185 have a uniform elasticity or force-deflection characteristic each of the blind segments 152 will be rotated to the same degree upon rotation of the so called master slide 154 by the baton 190. As shown by the sectional plan view of FIG. 19 the slide members 154 may be rotated almost 90° in each direction from the open position of the blind segments 152 to the point where the elastic members 185 are adjacent to each other and whereby the segments are substantially closed but remain parallel to each other. In the view of FIG. 19 the segments 152 are shown rotated in a clockwise direction in phantom. The segments may, of course, be rotated counterclockwise from the maximum open position to the same extent.

When it is desired to traverse the blind segments 152 between a stacked condition directly adjacent each other and a fully extended condition, traversal of the end slide member 154 by the baton will stretch the elastic members 185 uniformly to provide even spacing between each slide member 154 and associated blind segment 152. It will be appreciated from the foregoing description that a vertical blind traversal and rotating mechanism in accordance with the present invention is particularly advantageous in that the functions of traversal and rotation of the blind segments uniformly spaced and in unison with each other may be obtained by a mechanically uncomplicated system.

Figure 20:
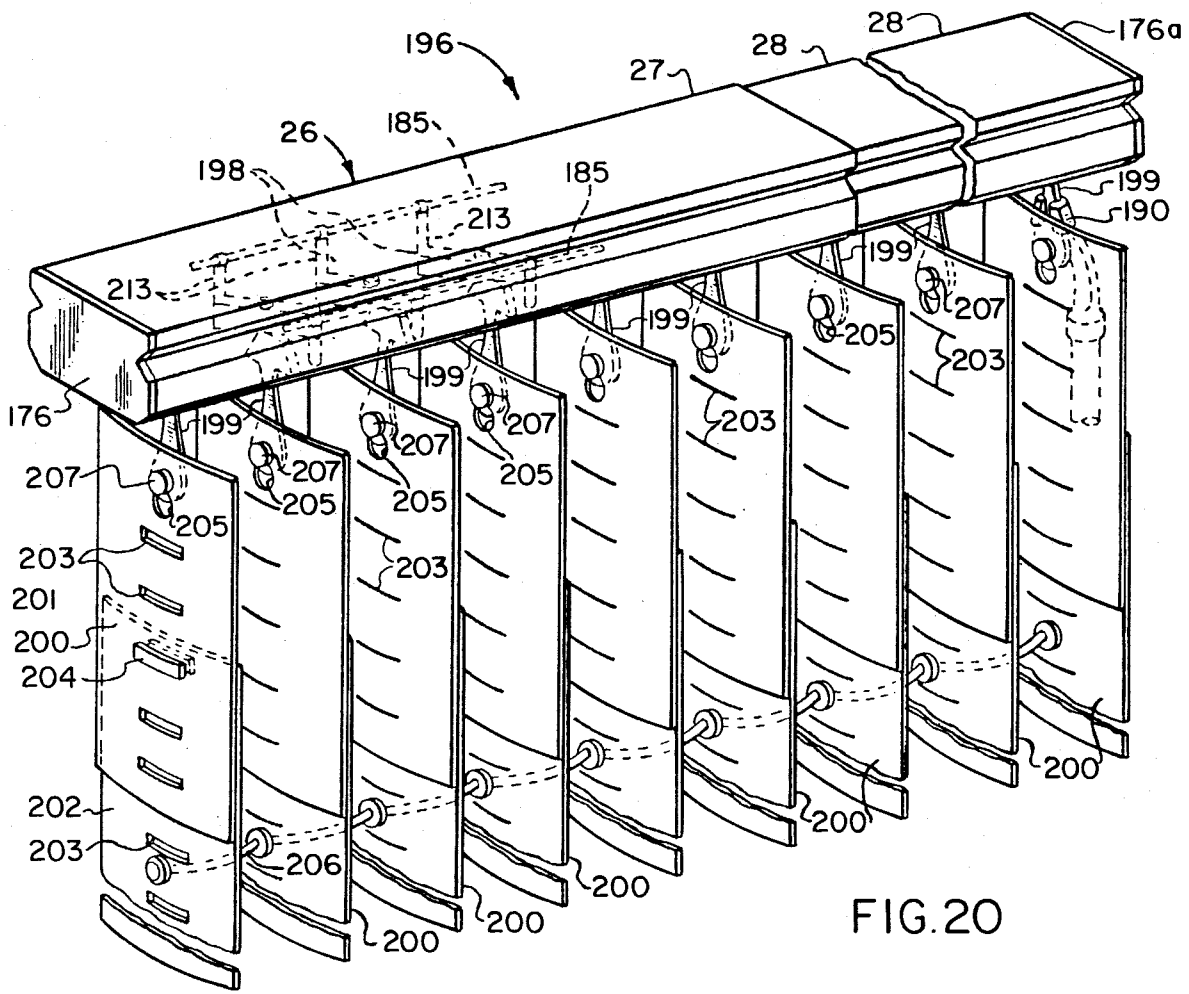
FIG. 20 is a perspective view of a fourth alternate embodiment of the present invention.

Referring to FIG. 20, there is illustrated an alternate embodiment of a vertical blind support system generally designated by the numeral 196. The vertical blind system 196 includes the traverse rod 26 and a latching arrangement utilizing an end cap 176 and 176a at respective ends of the track, as shown in FIG. 20. The vertical blind support system 196 also includes a plurality of spaced apart slide members similar to the slide members 154 and designated, respectively, by numerals 198. The slide members 198 include depending shank portions 199 of a modified form adapted to suspend a plurality of vertical blind slats 200. The slide members 198 each include opposed arms 213 which are interconnected by the traverse and rotating swivel and elastic member assemblies 180–185 of the embodiment of FIG. 17. The blind segments 200 are characterized by two separate segments 201 and 202 which are each provided with a series of spaced apart generally rectangular openings 203 into which transparent plastic inserts 204 may be inserted to interconnect the blind segments with each other in preselected positions to vary the overall length of the closure formed by the blinds of the system 196. The blind segments 201 are each provided with a modified upper end having a keyhole shaped opening or slot 205 formed therein which is adapted to be supported by the shank 199 having a cooperable hook portion 207. A baton 190 may be connected to the shank 199 of one of the end slide members 198 as shown in FIG. 20. The blind segments 200 may also be interconnected by an elastic member 206 to assist in providing uniform spacing and alignment of the blind segments. Packaging of the blind segments 201 and 202 is also made convenient by the separable configuration of the segments.

Figure 21:
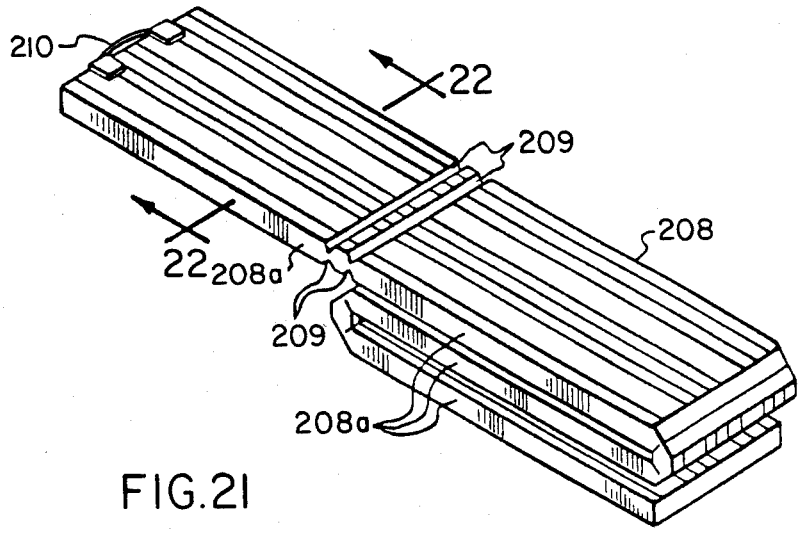
FIG. 21 is a perspective view of an alternate type of blind slats for use with the embodiment of FIG. 20.
Figure 22:
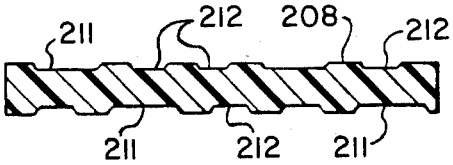
FIG. 22 is a section view taken along line 22—22 of FIG. 21.

Yet another embodiment of a vertical blind segment is illustrated in FIGS. 21 and 22 and generally designated by the numeral 208. The blind segment 208 is adapted to be folded to facilitate packaging for a prepacked vertical blind system including the complete traverse system and a sufficient number of the blind segments 208. As shown in FIG. 21 the blind segment 208 is provided with transverse scorings or "Vee" shaped notches 209 which provide hinges to permit folding of the segment 208 into a plurality of folds 208a. The blind segment 208 is also provided with a hook portion 210 to provide for hanging the blind segment from the slide members 198, for example. The segments 208 are preferably formed of a suitable plastic and may be extruded to provide a longitudinally ribbed configuration, as indicated by the grooves 211 and 212 FIG. 22, to enhance their aesthetic appeal and reflect light and sound in a dispersing manner.

Figures 23, 24:
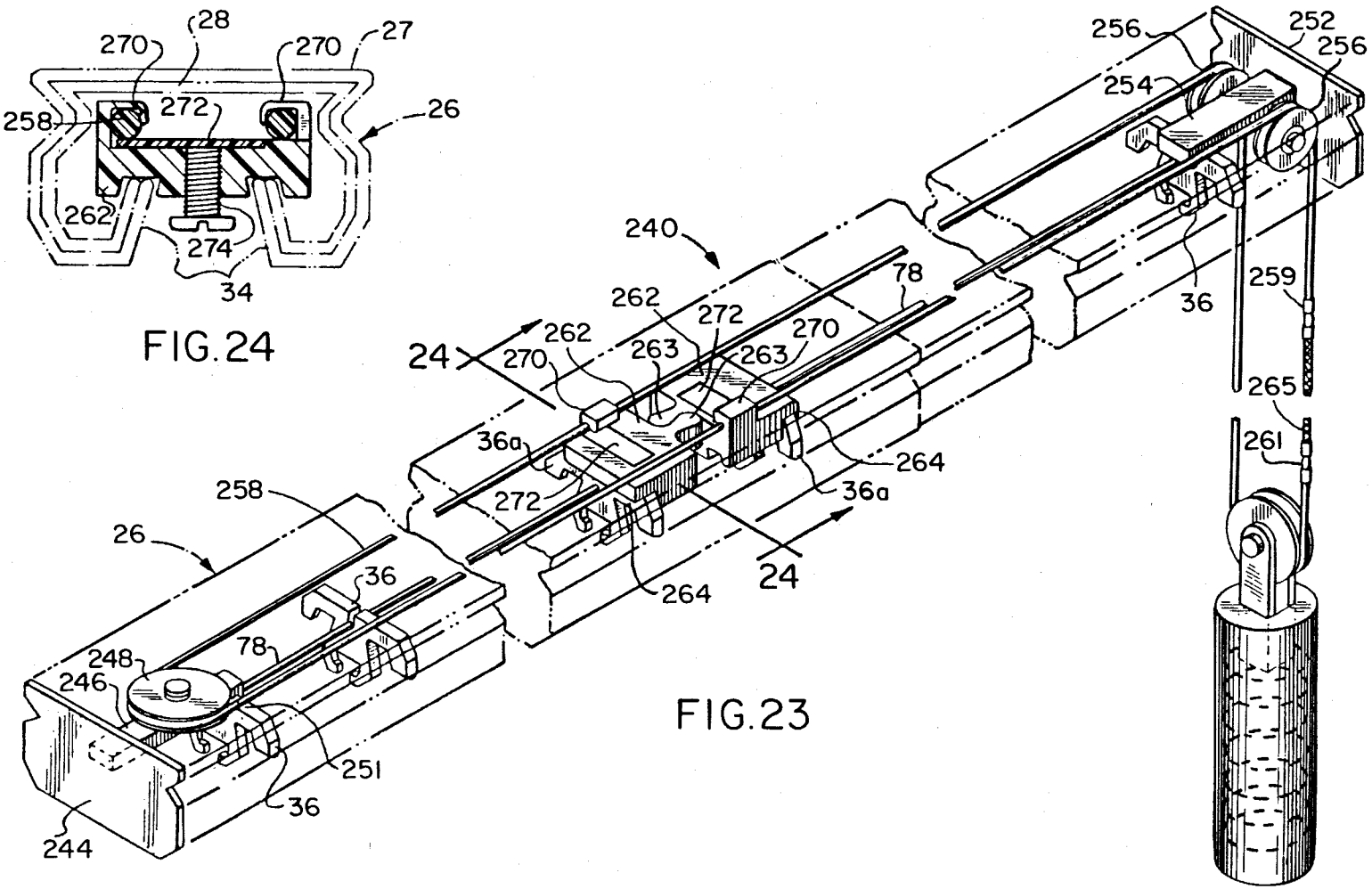
FIG. 23 is a perspective view of a fifth alternate embodiment of a drapery traverse system in accordance with the present invention.
FIG. 24 is a section view taken along line 24—24 of FIG. 23.

Referring now to FIGS. 23 and 24 there is illustrated a drapery support system, generally designated by the numeral 240, which is adapted for supporting and traversing relatively heavy draperies and wherein an improved endless elastic traverse member arrangement is arranged in combination with the stretchable elastic traverse member for spacing the drapery pleat slides. The drapery support system 240 is adapted to utilize the traverse rod 26 with modified end caps, which will be described hereinbelow, and a plurality of spaced apart pleat supporting slides 36 which are interconnected by the elastic member 78. The drapery panels and hangers have been omitted in FIG. 23 in the interest of clarity and conciseness. A modified end cap 244 is connected to the traverse rod 26 at one end thereof and includes a support beam 246 for supporting a rotatable elastic traverse member pulley 248. The beam 246 is also adapted to include a recess 251 thereby forming a latch mechanism for retaining one of the slide members 36 latched thereto. The opposite end of the traverse rod 26 is provided with a modified end cap 252 having a beam portion 254 also projecting within the channel space formed by the traverse rod 26 and adapted to support spaced apart elastic traverse member pulleys 256 rotatable in a plane perpendicular to the plane of rotation of the pulley 248. The drapery support system 240 includes a so called endless elastic traverse member 258 which is trained over the pulleys 256, around the pulley 248 and around a conventional tension pulley 260 suitably secured to a wall or other structure adjacent to the drapery support system.

The elastic traverse member 258 is arranged as an endless elastic member but is also preferably formed with ball and socket connecting links 259 and 261 which are secured to opposite ends of the elastic member 258. The links 259 and 261 preferably comprise a so called bead chain type connection between the ends of the elastic member 258 and a section of elastic member 265 inserted in the endless elastic member 258 and used as means for tensioning the elastic traverse member in addition to or in place of the pulley 260.

The traverse mechanism for the drapery support system 240 includes a pair of master slide blocks 262 which each include at one end a flange 264 and a recess formed thereby for receiving the arms 37 of a slide member 36 in latched relationship. The slide blocks 262 each include interlocking coupler tongues 263 projecting from the end of the block opposite the flange 264 and configured to be elastically deflected laterally to releasably interlock with one another when engaged in abutting relationship as shown in FIG. 23. As shown in FIG. 24 also, the slide blocks 262 each further include a elastic traverse member clamping jaw arrangement including a fixed jaw 270 and a releasable jaw member 272 which is adapted to be biased toward the jaw member 270 by a set screw 274 to clamp the block 262 to the elastic member 258. The jaw member 272 is suitably hinged to the block 262 at the end opposite that which engages the elastic member 258. The traverse slide blocks 262 may be clamped to opposed runs of the endless elastic traverse member 258, as illustrated in FIG. 23, and, by being connected to opposed ones of the end slides **36*a*, are operable to extend the drapery panels connected to the slides to a closed position wherein the coupler tongues 263 interlock to hold the draperies closed against the tension in the elastic traverse member 78. Accordingly, the concept of the elastic traverse member in combination with the unique pleat supporting slides 36** may be used in applications involving relatively heavy drapery panels and wherein remote control of traversal of the panels between open and closed positions is desired, such as theater curtains and the like.

Figure 25:
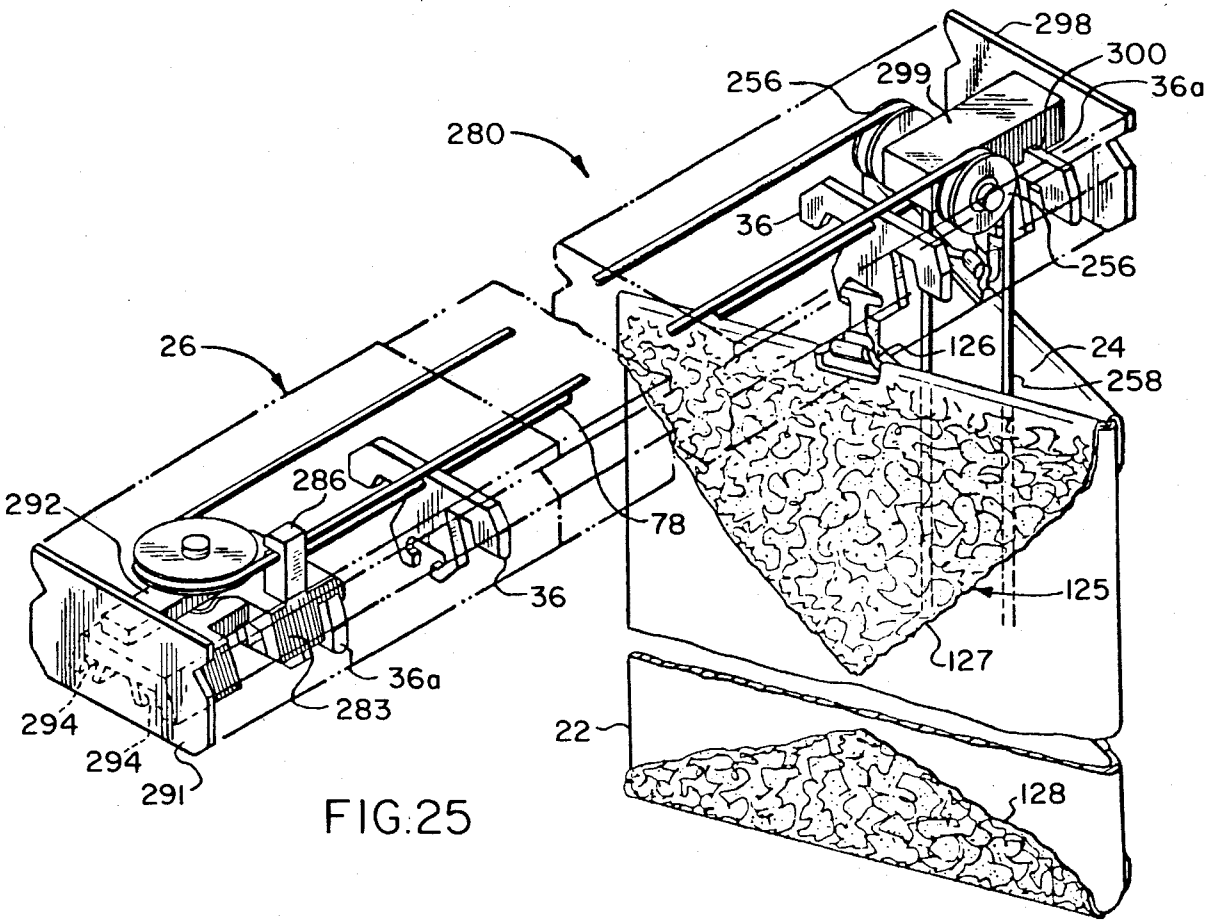
FIG. 25 is a perspective view of a modified end portion of the system shown in FIG. 23.
Figure 26:
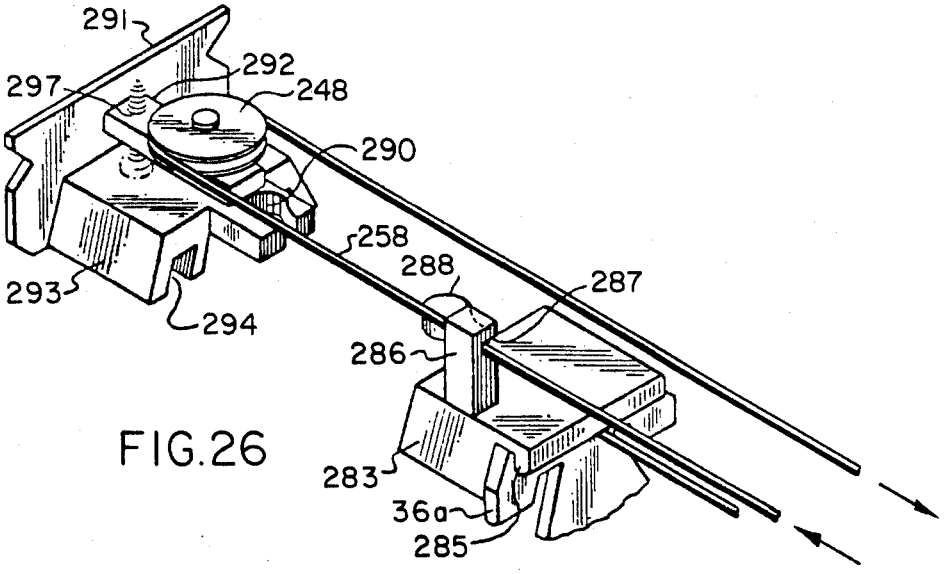
FIG. 26 is a detail perspective view of the system of FIG. 25.

Referring now to FIGS. 25 and 26, a modified arrangement of a drapery support and traverse system is shown and is generally of the type illustrated and described in conjunction with FIGS. 23 and 24. The drapery support system illustrated in FIGS. 25 and 26, generally designated by the numeral 280, includes a traverse rod 26, and a plurality of spaced apart slides 36 for supporting a one-way draw drapery panel 22. The slides 36 are interconnected by an elastic member 78 and an end slide **36*a* at the left end of the panel, viewing FIGS. 25 and 26, is connected to a master slide block 283 having a flange 285 forming a recess for latching the slide member 36*a* to the block. The block 283 is formed with a vertical projection 286 having a groove 287 formed therein into which the elastic traverse member 258** may be forcibly inserted at a preselected point and secured to the block.

The block 283 includes a generally horizontally projecting coupler tongue portion 288 which is adapted to be releasably latched into a receptacle 290 formed in a modified end cap 291 for the traverse rod 26. The end cap 291 also includes a generally horizontally projecting beam portion 292 for supporting a pulley 248 for the elastic traverse member 258. The receptacle 290 is formed on a body portion 293 of the end cap 291 which is provided with spaced apart grooves 294 adapted to fit over the flanges 34 and **34*a* of the traverse rod 26. A set screw 297 projects upwardly from the body 293 and through a suitable hole in the beam 292 and is adapted for engagement with the top web of one of the track sections 27 or 28** to lock the end cap in position on the end of track.

Referring to FIG. 25, the opposite end of the traverse rod 26 includes a modified end cap 298 having a generally horizontally projecting beam portion 299 for rotatably supporting the elastic traverse member pulleys 256. The beam 299 is adapted to lock an end slide **36*a* into a recess 300 so that an endmost pleat 24 of the panel 22 may be to the right of the elastic traverse member 258** to hide the elastic member between two pleats of a panel.

The operation of the drapery support system 240 and 280 is believed to be readily understandable from the foregoing description. However, upon assembly of the slides 36 in the support traverse rod 26 and connected to the respective elastic elastic traverse member 78, the support blocks 262 may be secured to the adjacent end slides 36 of the respective drapery panels. By holding the panels in a predetermined centered and closed position the blocks 262 may then be locked to the opposed runs of the endless elastic traverse member 258 by tightening of the respective set screws 274 with the opposed runs of the elastic member extending through the jaws 270, respectively. The drapery panels may then, of course, be extended or stacked back in accordance with the direction of movement of the elastic member 258.

FIG. 25, also illustrates an alternate embodiment of an arrangement of hangers for the drapery panel 22.

The hangers for the panel 22 are each designated by the numeral 125, one shown and are provided with a hook portion 126 and a decorative shield 127. The shield 127 may take various forms and designs and may be suitably secured to the upper edge of the panel by an adhesive, by sewing the edge of the panel to a portion of the shield along the upper edge thereof. The hanger 125 may be formed as a somewhat inverted U-shaped member, when viewed in cross-section, and wherein the portions forming the shield 127 form the opposed legs of the U-shaped member. Accordingly, the shield may be displayed on both sides of the pleats 24 of the panel.

The panel 22, in FIG. 25, is also adapted to include decorative pleat weights, one shown and designated by the numeral 128. The weights 128 are formed to have a shape corresponding to the shield 127 but are typically not provided with the hook eye or loop portion 126. The pleat weights 128 may also be attached to the bottom edge of the drapery panel and aligned with each of the pleats by suitable adhesive or by sewing the weights to the bottom edge of the panel. The decorative hanger members 125 and the pleat weights 128 may be formed of a suitable injection molded plastic, for example, in a wide variety of designs and colors.

Figure 32:
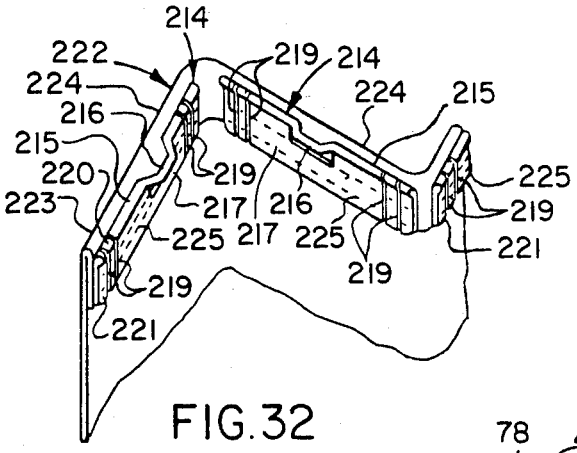
FIG. 32 is a perspective view of an embodiment of a hanger for use with the drapery support system of the present invention.

Another embodiment of a hanger for use with the drapery systems of the present invention is illustrated in FIG. 32. FIG. 32 is a detail perspective of a portion of the backside of a drapery panel 222 including folds or pleats 224. The modified hangers illustrated in FIG. 32 are designated by the numeral 214 and each includes an integral substantially rigid rod portion 215 with a hook portion 216 formed intermediate the opposite ends of the rod portion. The hanger 214 also includes a substantially flat blade portion 217 which is integral with the rod portion 215 and is adapted to be sewn to the upper edge 223 of the panel 222 as indicated by the stitching 225. The hanger 214 is also scored in a vertical direction at points indicated by the numeral 219 in FIG. 32 so that integral hinge portions 220 and 221 are formed at opposite ends of the hanger as indicated. The hinge portions 220 and 221 are adapted to bend with respect to the central portion of the hanger 214 so that the drapery pleats 224 have a relatively soft, rolling or undulating appearance as opposed to a sharp line of intersection between the pleats 224. The hanger 214 is preferably molded of a suitable plastic material and the scored portions 219 may be formed at the time of molding the part to provide for the hinging action. The blade portion 217 is relatively thin to facilitate stitching the hangers to the upper edges of the pleats 224.

It is to be noted that the invention described and illustrated herein is not limited to use with an adjustable length track or traverse rod nor a traverse rod having its opening at the bottom thereof. Accordingly, the present invention may be advantageously used with a fixed length traverse rod as well as a traverse rod having its opening or longitudinal track along its top, front or back surface. Similarly, the type of drapery used with the invention is not to be considered as limiting the invention.

Although several embodiments of a drapery support system in accordance with the present invention have been described herein, those skilled in the art will realize that various substitutions and modifications may be made to the specific arrangements described without departing from the scope and spirit of the invention as recited in the appended claims.

I claim as my invention:

1. Support and traverse apparatus for a vertically hanging closure or drapery formed by a plurality of adjacent pleats, said drapery fitting across an opening which is to be covered by said drapery comprising an elongated traverse rod a plurality of movable members each being supported by said traverse rod and adapted for traversing movement therealong means for rotationally attaching each of said movable members to respective pleats of said drapery stretchable means, comprising an elongated elastically stretchable member capable of being elastically stretched at least approximately 1.25 times its relaxed length while its cross-sectional area is being correspondingly reduced, attached to each of said movable members at substantially equally spaced locations along said stretchable member for maintaining substantially equal, but variable, spacing between said pleats from when said stretchable member is taut and the drapery is partially closed to when said stretchable member is extended to fully close the drapery, and at any drapery position therebetween.

2. The apparatus of claim 1, wherein said elongated elastically stretchable member comprises natural rubber.

3. The apparatus of claim 1, wherein said elongated elastically stretchable member comprises synthetic rubber.

4. The apparatus of claim 1, wherein said elongated elastically stretchable member comprises a core material of natural or synthetic rubber with sheath means positioned around the outside of said core material for limiting the stretchability of the core material.

5. The apparatus of claim 4, wherein the sheath material limits the stretchability of the core material to approximately 2.5 times its relaxed length.

6. In the apparatus of claim 1, gathering means attached to each of said movable members and to said elastically stretchable member for gathering the lengths of the elastically stretchable member between said movable members into a predetermined arrangement when said elastically stretchable member is relaxed and said drapery is substantially fully open whereby the gathered lengths of said elastically stretchable member are positioned away from said movable members so as not to interfere with side-by-side stacking of said movable members.

7. The apparatus of claim 6, wherein said gathering means comprises a pair of spaced cooperating surfaces with a first surface attached to a first movable member and a second surface attached to an adjacent movable member and positioned such that said first and second surfaces converge toward each other and at a fixed non-right angle relative to the longitudinal axis of said elastically stretchable member when said elastically stretchable member is taut.

8. The apparatus of claim 6, wherein said gathering means causes a pair of spaced surfaces with one surface being attached to a first movable member and the other surface attached to a second movable member adjacent to said first movable member and positioned such that said spaced surfaces are substantially parallel to each other and at a fixed non-right angle relative to said elastically stretchable member when said elastically stretchable member is taut.

9. The apparatus of claim 7, wherein each movable member has attached thereto a substantially annular member with said first and said second surfaces forming opposite sides thereof and whereby each of the opposite surfaces cooperates with the near surface on the adjacent movable member on each side thereof.

10. The apparatus of claim 9, wherein said elastically stretchable member fits tightly within the opening in said substantially annular member so as to be substantially rigidly fixed with respect thereto.

11. The apparatus of claim 10, wherein said substantially annular member includes a longitudinal opening through one wall thereof through which the elastically stretchable member may be inserted when applied to the substantially circular opening through said substantially annular member.

12. The apparatus of claim 8, wherein each movable member has attached thereto a substantially annular member with said first and second surfaces forming opposite sides thereof and whereby each of the opposite surfaces cooperates with the near surface on the adjacent movable member on each side thereof.

13. The apparatus of claim 12, wherein said elastically stretchable member fits tightly within the opening in said substantially annular member so as to be substantially rigidly fixed with respect thereto.

14. The apparatus of claim 13, wherein said substantially annular member includes a longitudinal opening through one wall thereof through which the elastically stretchable member may be inserted when applied to the substantially circular opening therein.

15. The apparatus of claim 9, wherein said substantially annular member is rotationally attached to said movable member.

16. The apparatus of claim 2, wherein each of said movable members are rotationally attached to said respective pleats of said drapery.

17. In the apparatus of claim 2, latch means attached to said traverse rod for securing the side ends of said drapery to respective spaced apart positions along said traverse rod.

18. The apparatus of claim 1, wherein said elongated traverse rod is adjustable in length between a first position and a second longer position and said stretchable means is elastically stretchable to said first and said second positions whereby a pleated drapery having a width capable of fitting between said first and second positions is provided with evenly spaced pleats at any extended position therebetween after said stretchable means is stretched taut.

* * * * *

UNITED STATES PATENT AND TRADEMARK OFFICE

CERTIFICATE OF CORRECTION

PATENT NO. : 4,724,883

DATED : February 16, 1988

INVENTOR(S) : Martin N. Leibowitz

It is certified that error appears in the above-identified patent and that said Letters Patent are hereby corrected as shown below:

Title page:

The name of the inventor is incorrectly spelled:

The correct spelling is "Martin N. Leibowitz."

Signed and Sealed this

Twelfth Day of July, 1988

*Attest:*

*Attesting Officer*

DONALD J. QUIGG

*Commissioner of Patents and Trademarks*